US006657598B2

(12) United States Patent
Tulloch

(10) Patent No.: US 6,657,598 B2
(45) Date of Patent: Dec. 2, 2003

(54) METHOD OF AND APPARATUS FOR ANTENNA ALIGNMENT

(75) Inventor: Tom Tulloch, Aberdour (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/977,023

(22) Filed: Oct. 12, 2001

(65) Prior Publication Data

US 2003/0071762 A1 Apr. 17, 2003

(51) Int. Cl.[7] ..... H01Q 3/00

(52) U.S. Cl. ..... 343/765; 343/766; 343/880; 343/882

(58) Field of Search ..... 343/757, 765, 343/766, 878, 880, 881, 882; 248/170, 171, 179, 544; H01Q 3/00

(56) References Cited

U.S. PATENT DOCUMENTS

| | | | | | |
|---|---|---|---|---|---|
| 3,877,662 | A | * | 4/1975 | Reiter et al. | 244/170 |
| 4,232,320 | A | | 11/1980 | Savalle, Jr. | 343/765 |
| 4,458,554 | A | * | 7/1984 | Hrastar | 74/573 R |
| 4,528,569 | A | * | 7/1985 | Felter et al. | 343/840 |
| 4,598,297 | A | * | 7/1986 | Hawkins | 343/878 |
| 4,602,259 | A | | 7/1986 | Shepard | 343/359 |
| 4,726,242 | A | | 2/1988 | Baghdasarian | 74/89 |
| 4,802,386 | A | | 2/1989 | Haack | 74/798 |
| 4,819,007 | A | | 4/1989 | Tezcan | 343/840 |
| 4,901,369 | A | * | 2/1990 | Momose et al. | 455/84 |
| 5,048,356 | A | * | 9/1991 | Levko | 74/60 |
| 5,245,351 | A | | 9/1993 | Chou | 343/766 |
| 5,274,382 | A | * | 12/1993 | Wills et al. | 342/359 |
| 5,486,838 | A | | 1/1996 | Dienes | 343/781 R |
| 5,576,722 | A | * | 11/1996 | Bustillos | 343/882 |
| 5,633,647 | A | | 5/1997 | Tines | 343/766 |
| 5,760,748 | A | * | 6/1998 | Beckingham | 343/765 |
| 5,835,068 | A | | 11/1998 | Paul et al. | 343/757 |
| 5,875,685 | A | | 3/1999 | Storaasli | 74/490.1 |
| 5,977,922 | A | | 11/1999 | Hemmingsen, II | 343/760 |
| 5,999,139 | A | | 12/1999 | Benjamin et al. | 343/765 |
| 6,081,240 | A | | 6/2000 | Hemmingsen, II | 343/760 |
| 6,094,174 | A | | 7/2000 | Knop et al. | 343/781 R |
| 6,107,973 | A | | 8/2000 | Knop et al. | 343/781 P |
| 6,262,691 | B1 | * | 7/2001 | Austin et al. | 343/890 |
| 6,357,127 | B1 | * | 3/2002 | Cochran | 33/286 |
| 6,433,757 | B1 | * | 8/2002 | Shrader | 343/915 |

* cited by examiner

*Primary Examiner*—Tho Phan
(74) *Attorney, Agent, or Firm*—Jenkens & Gilchrist, P.C.

(57) ABSTRACT

An alignment mechanism to assist in antenna alignment is described. The alignment mechanism has a first attachment element for removably attaching to an antenna mounting member, a threaded sleeve member affixed to the first attachment element, a threaded bushing for threadably engaging the threaded sleeve member, and a handle member provided for rotating the threaded bushing. A second attachment element is provided for removably attaching to an antenna mounting base member. The second attachment element is operatively connected to the threaded bushing. A biasing member is adapted for biasing the first attachment member apart from the second attachment member. An adjustment member is threadably connected to the second attachment element and operatively connected to the threaded bushing, the adjustment member for selectively adjusting an axial distance between the first attachment member and the second attachment member.

39 Claims, 20 Drawing Sheets

METHOD OF AND APPARATUS FOR ANTENNA ALIGNMENT

BACKGROUND

1. Field of the Invention

The present invention relates to antenna alignment systems and, more particularly, but not by way of limitation, to a device for aligning an antenna by the combination of initial adjustment and selectively staged, controlled movement thereof preparatory to a secondary adjustment.

2. History of Related Art

The importance of accurately aligning a communication antenna relative to the associated signal source with which the antenna is positioned to communicate is well known. Such alignment is necessary for both land based and satellite based signal transmission systems. In either installation, it is important that the antenna be aligned along at least two axes. The first axis is that of the horizontal orientation of the antenna, or azimuth, and the second axis is that of the vertical orientation or elevation. Other antenna alignment aspects include the hour angle axis and the like, as set forth in U.S. Pat. No. 4,232,320 assigned to assignee of the present invention. As set forth in the '320 Patent, it is well established that the ability to assemble, mount and align an antenna with the fewest manual adjustments and the most efficiency is of great advantage. The requisite mounting assembly necessary for such alignment is, however, a matter of constant design emphasis.

As set forth above, the precise alignment of antennas is a critical function. In order to facilitate alignment, electronic devices such as those that measure the strength of the signal to the antenna have been designed for use during the antenna installation. It is, however, necessary that the antenna be generally aligned with its designated signal source, such as a satellite, before such electronic devices that measure the strength of the signal to the antenna can be utilized. A coarse alignment of the antenna is thus necessary in order to first obtain a signal for subsequent dual axis tuning of the antenna's azimuthal and elevational orientations.

It is also well known that the proper installation of an antenna is dependent upon an appropriate mounting platform, or base, and associated mounting hardware for use therewith. The stability of the base and the reliability of the mounting hardware are critical to a proper installation. The reliable and efficient mounting of the antenna is also dependent upon a viable method of and apparatus for aligning both azimuthal and elevational orientations accommodating both environmental and expense issues. Such antenna alignment must, however, provide a reliable positioning of the antenna about the above-referenced axes while affording ease in the ultimate securement of the antenna about the mounting base.

Ultimate securement of an antenna necessitates a primary alignment system that does not manifest backlash and/or other relative movement between parts that results in secondary misalignment of the antenna. Primary alignment occurs when the antenna is being oriented and precisely positioned relative to detected antenna signal strength. Once this determination of precise alignment has been determined, secondary misalignment can be caused by a variety of reasons including improperly designed systems, incorrectly assembled hardware, and/or loose connections between mounting members. Any degree of relative movement between mounting or alignment members, such as the above-referenced backlash, can result in secondary misalignment. It has been noted that much secondary misalignment of antennas during installation is the result of backlash, which itself has been a subject of a number of prior designs for antenna alignment devices. For example, U.S. Pat. No. 5,245,351 discloses an orientation adjusting device for a satellite transmitting antenna incorporating an electromechanical actuation system. In this particular example, the system is built into the antenna mounting assembly. The inclusion of such an electromechanical system is not always feasible. Notwithstanding this fact, the system of the '351 Patent incorporates a gear pivotally fixed on the housing and biased so as to maintain a more precise engagement to reduce the backlash normally associated with a gear drive. The biasing of the gear drive then provides the inherent accuracy and stability for antenna alignment necessarily maintained for the system is to operate correctly.

Although electromechanical systems can be utilized for the orientation and adjustment for a given satellite antenna or the like, such systems are inherently expensive and generally require a power source and maintenance. Certain antenna installations are of the nature that an initial alignment must be manually performed during installation with the antenna subsequently secured in that precise alignment. Such installations require appropriate mechanical mounting systems, including base, couplings, clamps and strut assemblies and other devices that facilitate the direction for and desired degree of antenna movement for the orientation of the antenna. For example, U.S. Pat. No. 5,977,922 teaches a satellite antenna alignment device that is temporarily mounted to a support arm of the antenna to indicate the directional position. Other apparatus and systems are used to impart precise movement to the antenna for alignment purposes as well as the subsequent securement of the requisite mounting members for maintaining that alignment. Since the antenna must generally be aligned along at least two orthogonal axes, such mounting and coupling systems may be mechanically complex in that they are critical to efficient installations.

The present invention provides such an advance over existing mounting systems by utilizing an alignment mechanism capable of being demountably coupled to the antenna mounting structure for precisely aligning and tuning that structure and the associated antenna to obtain a true peak signal when using electronic testing equipment therewith. This operation is facilitated by the tool affording two separate degrees of adjustment. The first degree of adjustment allows fine tuning of the antenna's position after the antenna is panned in during installation. The signal level is then monitored. The tool also provides a tuning step that alternatively allows movement of the antenna in mutually opposite, equal directions to thereby permit a determination of signal level strength variation and the concomitant ability to make further, secondary adjustments with the tool in response thereto.

BRIEF DESCRIPTION OF THE DRAWINGS

A more complete understanding of the method and apparatus of the present system may be obtained by reference to the following Detailed Description when taken in conjunction with the accompanying Drawings wherein.

DETAILED DESCRIPTION

It has been discovered that the angular orientation of an antenna may be precisely adjusted with an apparatus that allows selective adjustments of the antenna orientation to maximize effective receipt of signals from a satellite or the like. The apparatus may be built into an antenna mount or may be detachable. A single apparatus may be used to adjust both the azimuth and elevation. Often, due to the insensitivity of the signal level monitoring equipment, it is impossible to know whether the true peak of the signal level has been found. The method of and apparatus for antenna adjustment of the present invention allows adjustment of both the azimuthal and elevational orientation. The apparatus imparts antenna movement steps in opposite directions about a single alignment set position. This selective "waggle" movement causes the antenna to move in opposite directions for a determination of signal strength increase or decrease. If the signal receipt level drops by an equal value during the waggle movement, then it is known that the antenna is aligned with the true peak. However, if the values are imbalanced during the waggle movement, then an adjustment can be made with the apparatus of the present invention and the process repeated until balance is achieved. These steps are accomplished with an anti-backlash mechanism built into the tool further facilitating stability in alignment.

Figure 1:
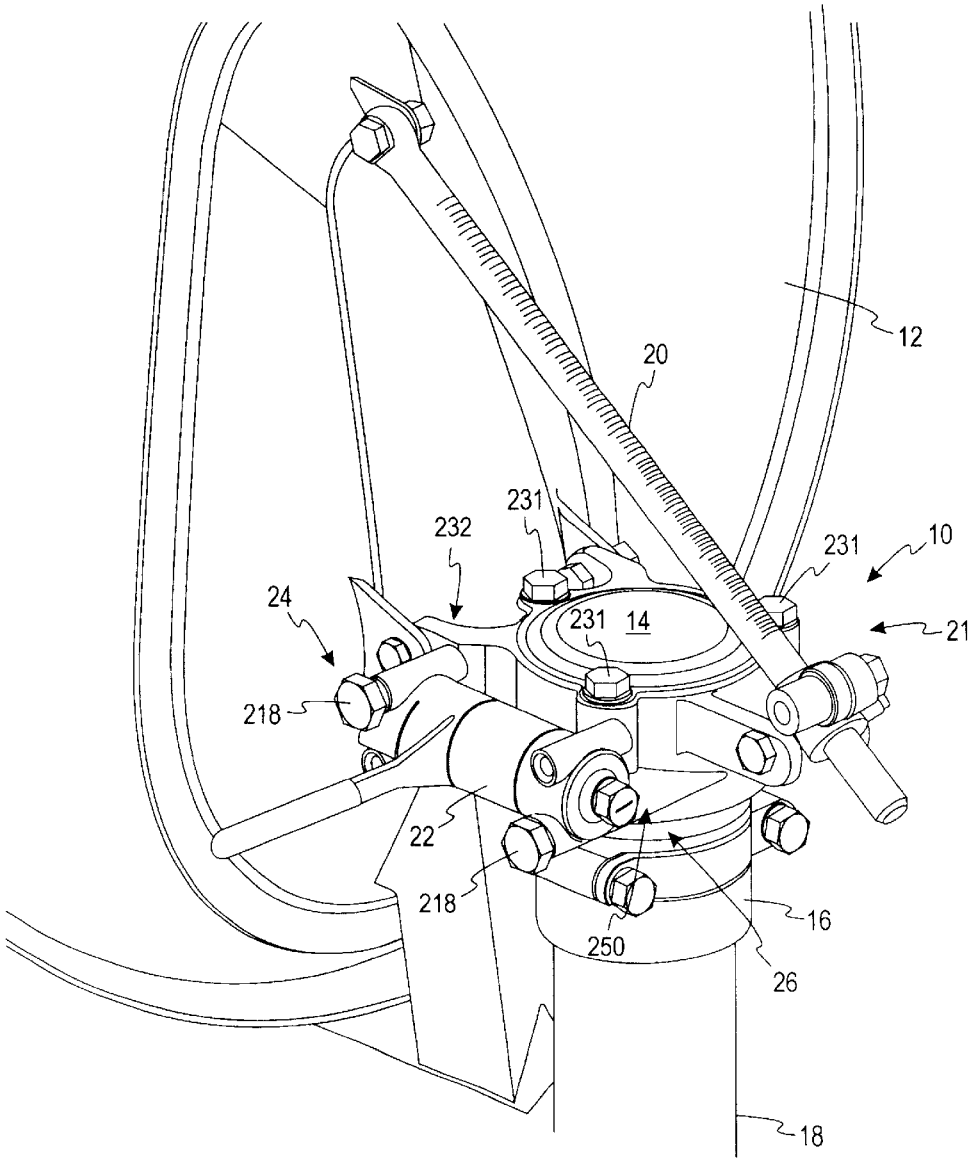
FIG. 1 is a perspective view of an antenna and its associated mounting structure illustrating one embodiment of the alignment mechanism of the present invention assembled thereto for adjusting the rotational alignment of the antenna.

Referring first to FIG. 1, there is shown an antenna assembly 10 with an alignment mechanism 22, constructed in accordance with the principles of the present invention, demountably coupled thereto. The antenna assembly 10 includes an antenna dish 12 pivotally connected to an upper casting 14, rotatably mounted to a lower casting 16 which is secured to an antenna mast or support post 18. An elevation adjustment strut 20 supports the back of dish 12 from orienting member or upper casting 14. Upper casting 14, stationary member or lower casting 16, support post 18, and elevation adjustment strut 20 comprise a mounting assembly 21 for the antenna dish 12.

Still referring to FIG. 1, the alignment mechanism 22 shown mounted to the antenna assembly 10 is demountably coupled therewith. A first end 24 of alignment mechanism 22 is connected to dish mounting arm 232 of the upper casting 14 and also demountably coupled to an alignment mechanism mounting hole 250 of lower casting 16 at a second end 26. In this position, alignment mechanism 22 is mounted to adjust the antenna dish 12 in a rotational, or azimuthal orientation. This adjustment, as defined in more detail below, is preferably done in conjunction with an electronic device capable of measuring the strength of a signal received by the antenna dish 12. The tool 22 is thus adjusted to move the antenna dish 12 into the appropriate position to reach peak signal strength. As will be defined below, the tool 22 also provides selective waggle movement subsequent to an initial alignment in a first set position to determine if the signal receipt level drops by an equal value during the waggle movement. If so, it is then known that the antenna dish 12 is aligned with a true peak signal for that particular axial positioning.

Figure 2:
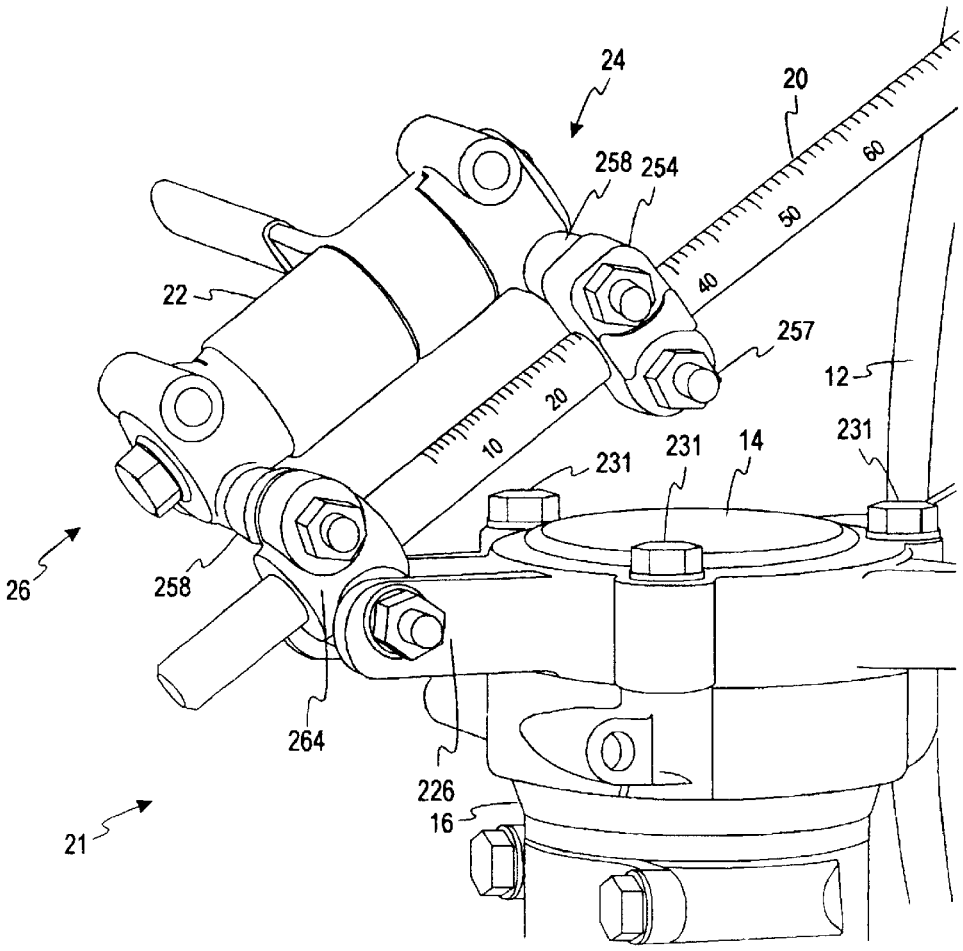
FIG. 2 is a perspective view of an antenna and its associated mounting structure illustrating the alignment mechanism of FIG. 1 assembled thereto for adjusting the elevational alignment of the antenna.

Referring now to FIG. 2, there is shown the antenna assembly 10 of FIG. 1 with the alignment mechanism 22 demountably coupled to a different region thereof. For reference purposes, the antenna assembly 10 of FIG. 2 incorporates the same components as set forth in FIG. 1, and therefore all reference numbers remain the same as described above. It should be noted, however, that alignment mechanism 22 is demountably coupled to elevation adjustment strut 20 in this particular view rather than the upper casting 14 as described in FIG. 1. In this position, it may be seen that the tool 22 is positioned to vary the position of the strut 20 relative to adjustment strut receiving arm 226 of upper casting 14 through the actuation of the tool 22. As will be described in more detail below, the tool 22 is constructed for the selective varying of the linear extent thereof in two independent modes, and these modes of actuation, as well as the construction of tool 22, will be described in further detail while making reference to FIGS. 1 and 2 set forth above.

Figure 3:
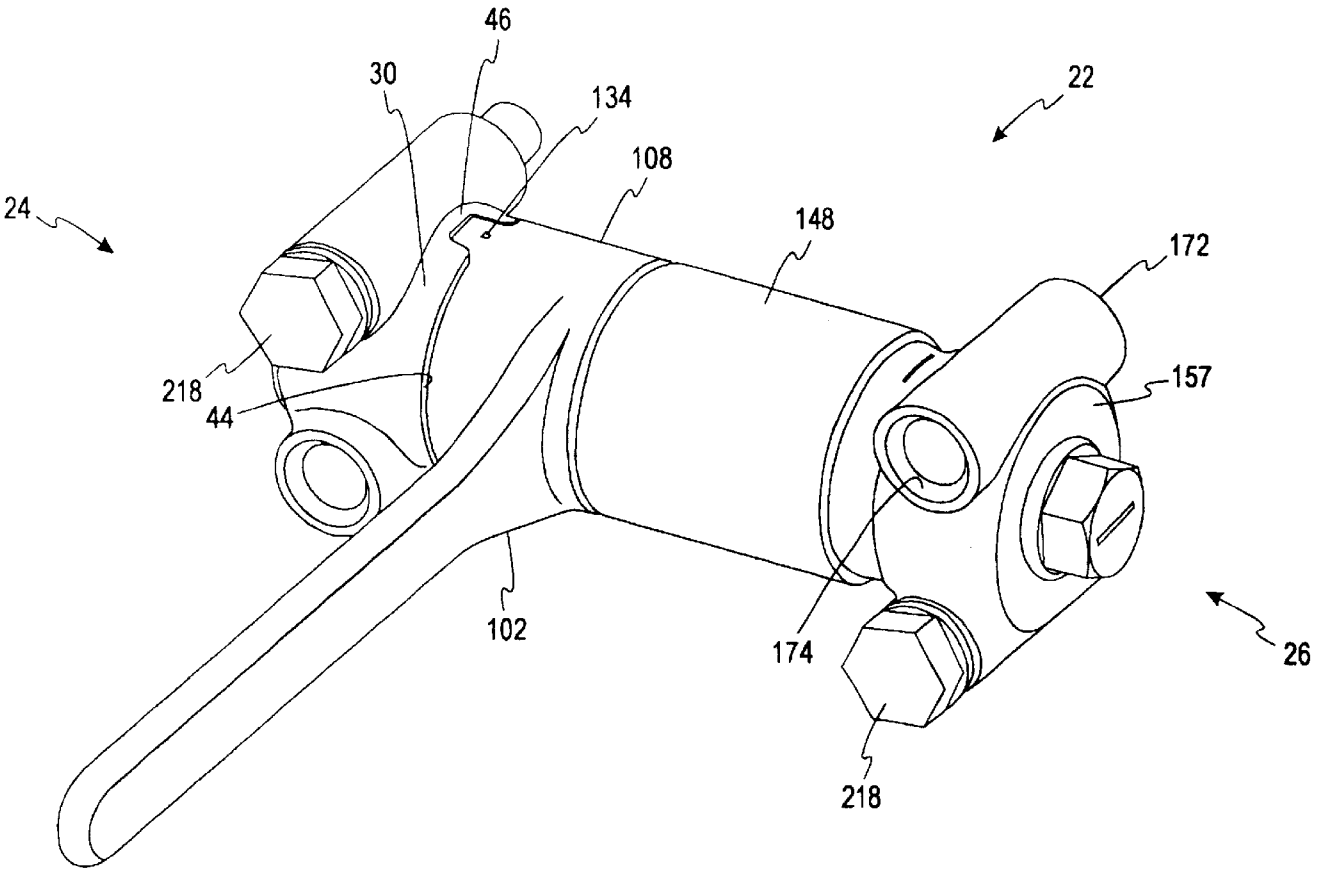
FIG. 3 is a perspective view of the alignment mechanism of FIG. 1.
Figure 4:
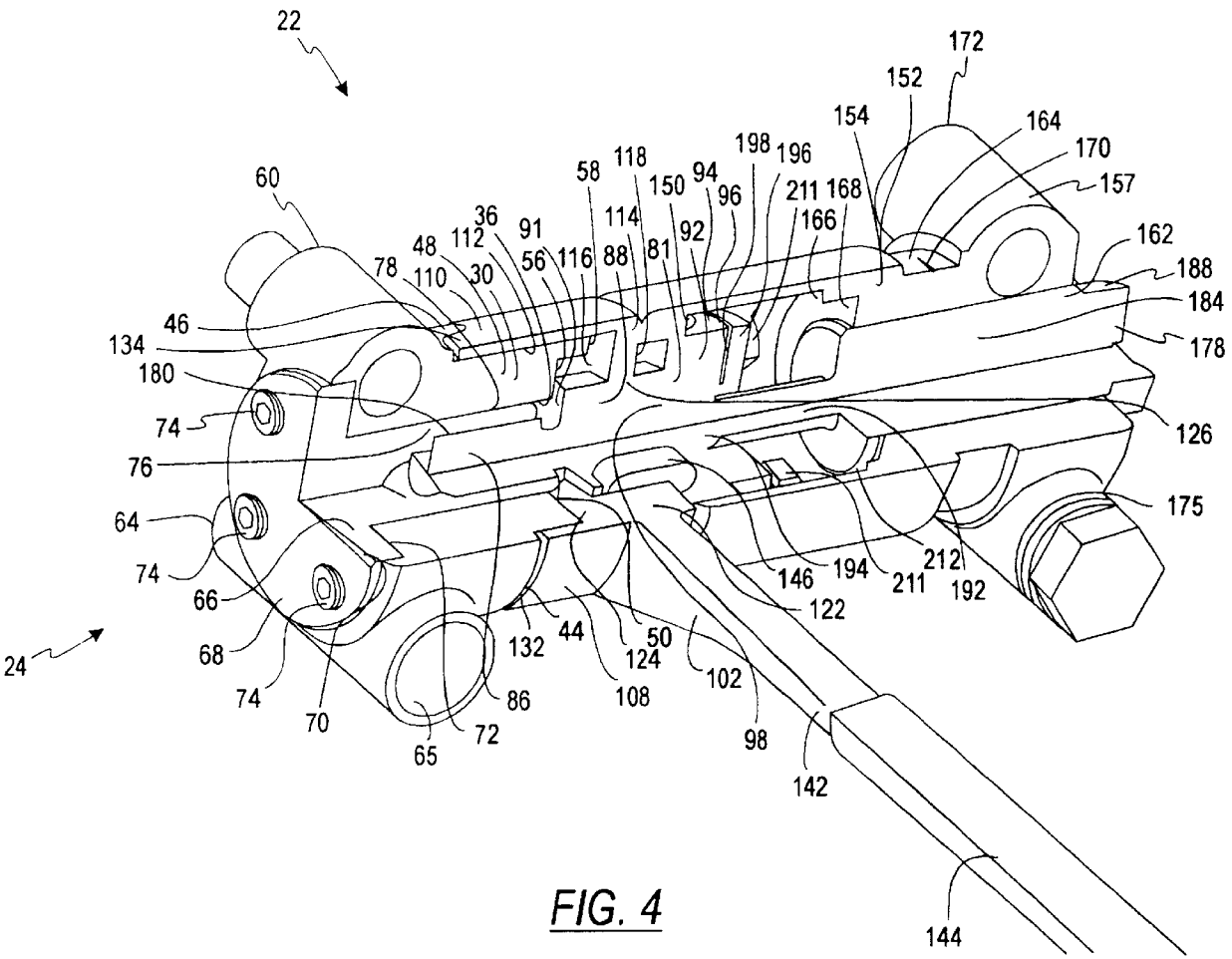
FIG. 4 is a partial cut-away perspective view of the alignment mechanism of FIG. 1.
Figure 5A:
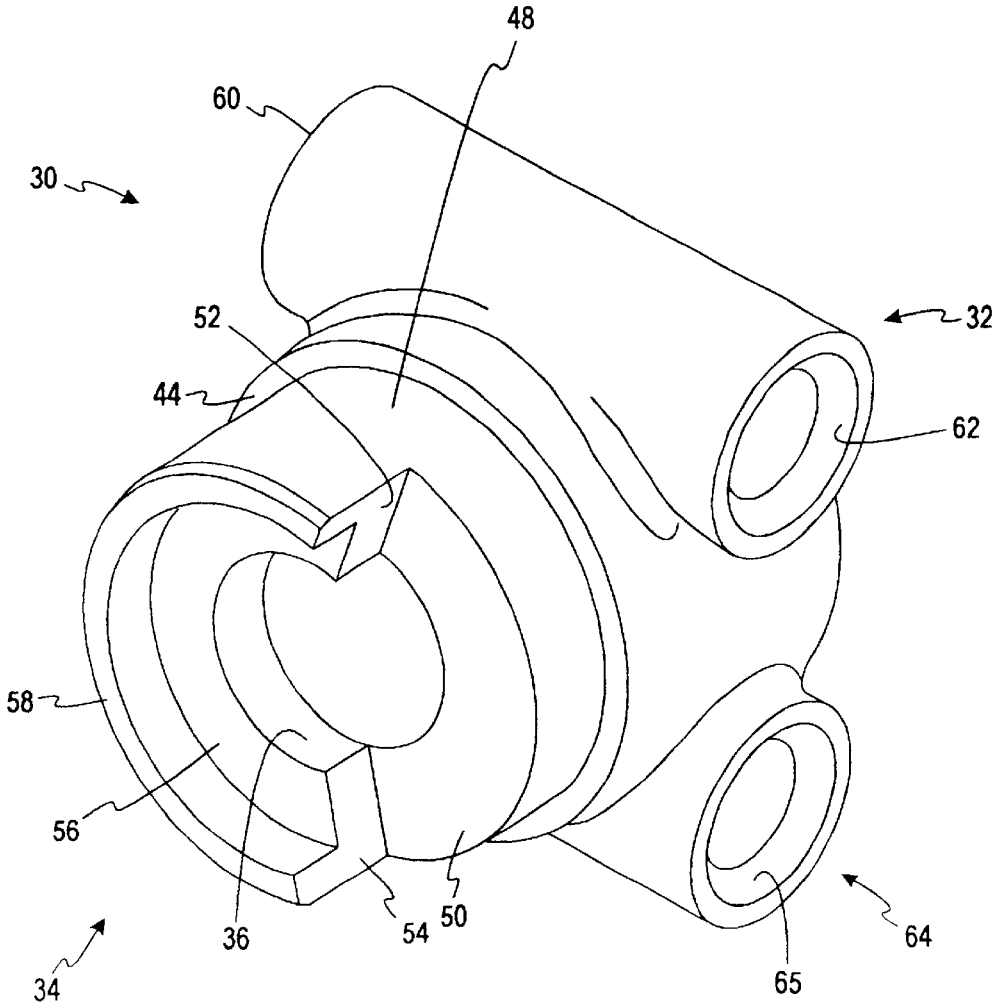
FIG. 5A is a perspective view of a first attachment element that is a part of the alignment mechanism of FIGS. 1–4.
Figure 5B:
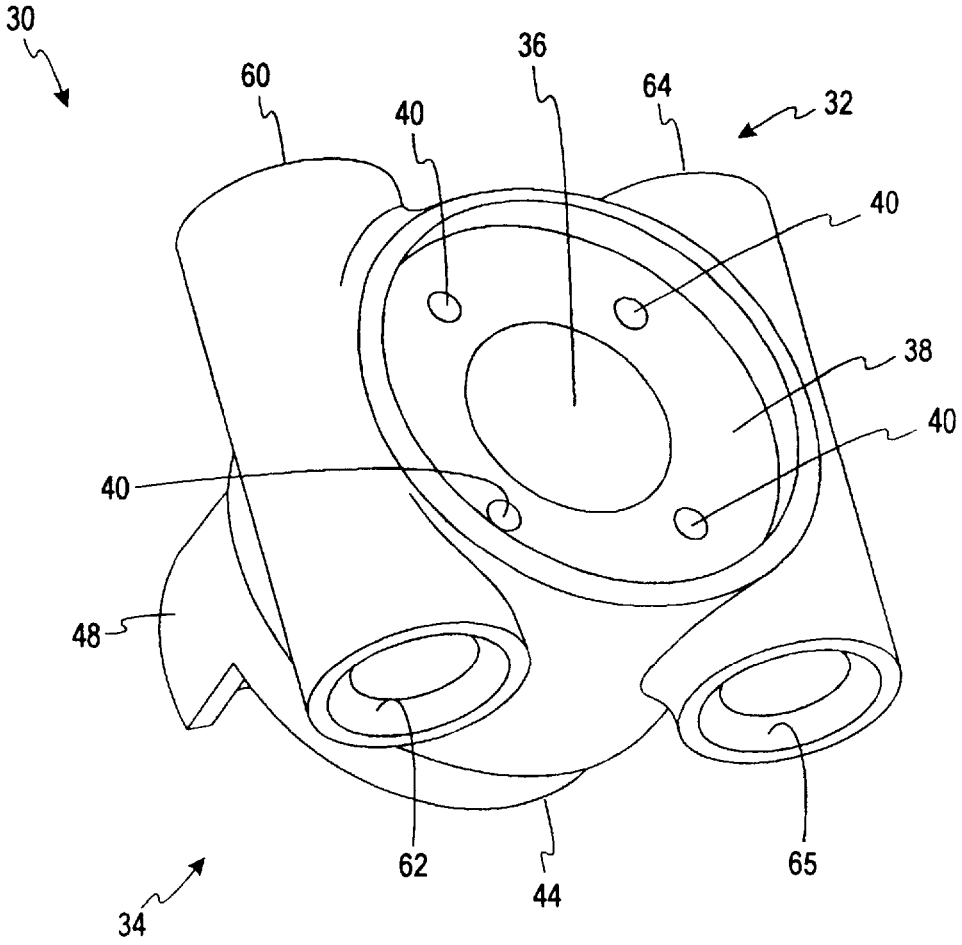
FIG. 5B is a second perspective view of a first attachment element that is a part of the alignment mechanism of FIGS. 1–4, viewed from a different direction.

Referring now to FIGS. 3, 4, 5 and 5*b*, in combination, FIGS. 3 and 4 show a perspective view of the alignment mechanism 22 (FIG. 3), and a perspective cutaway view of the alignment mechanism 22 (FIG. 4). These views will be referred to separately, and in combination, for providing a comprehensive explanation of the construction and operation thereof. Alignment mechanism 22 includes a first attachment element 30 on first end 24 of alignment mechanism 22. FIGS. 5*a* and 5*b* show perspective views of first attachment element 30. First attachment element 30 has an external end 32 and an internal end 34. First attachment element 30 has a smooth internal surface 36 (FIGS. 4, 5A and 5B). First attachment element 30 has a recessed area 38 (FIG. 5B) on external end 32. Four sleeve member holes 40 (FIG. 5B) are provided in recessed area 38. A handle-mating face 44 surrounds first attachment element 30. Handle-mating face 44 has a V-type recess 46 (best seen in FIG. 3). A tubular extension 48 on the internal end 34 has a smooth exterior wall that defines a stop-mating face 50 (FIGS. 4 and 5A). Stop-mating face 50 is bounded by a first stop 52 and a second stop 54 (FIG. 5A). Tubular extension 48 additionally has a ball joint member-mating face 56 and a rim 58 (FIGS. 4 and 5A). Attached to first attachment element 30 proximate external end 32 is a first transverse bolt hole 60. The first transverse bolt hole 60 has a chamfered end 62. Additionally, a second transverse bolt hole 64 is affixed to the first attachment element 30. The second transverse bolt hole 64 also has a chamfered end 65 formed thereon.

Figure 6:
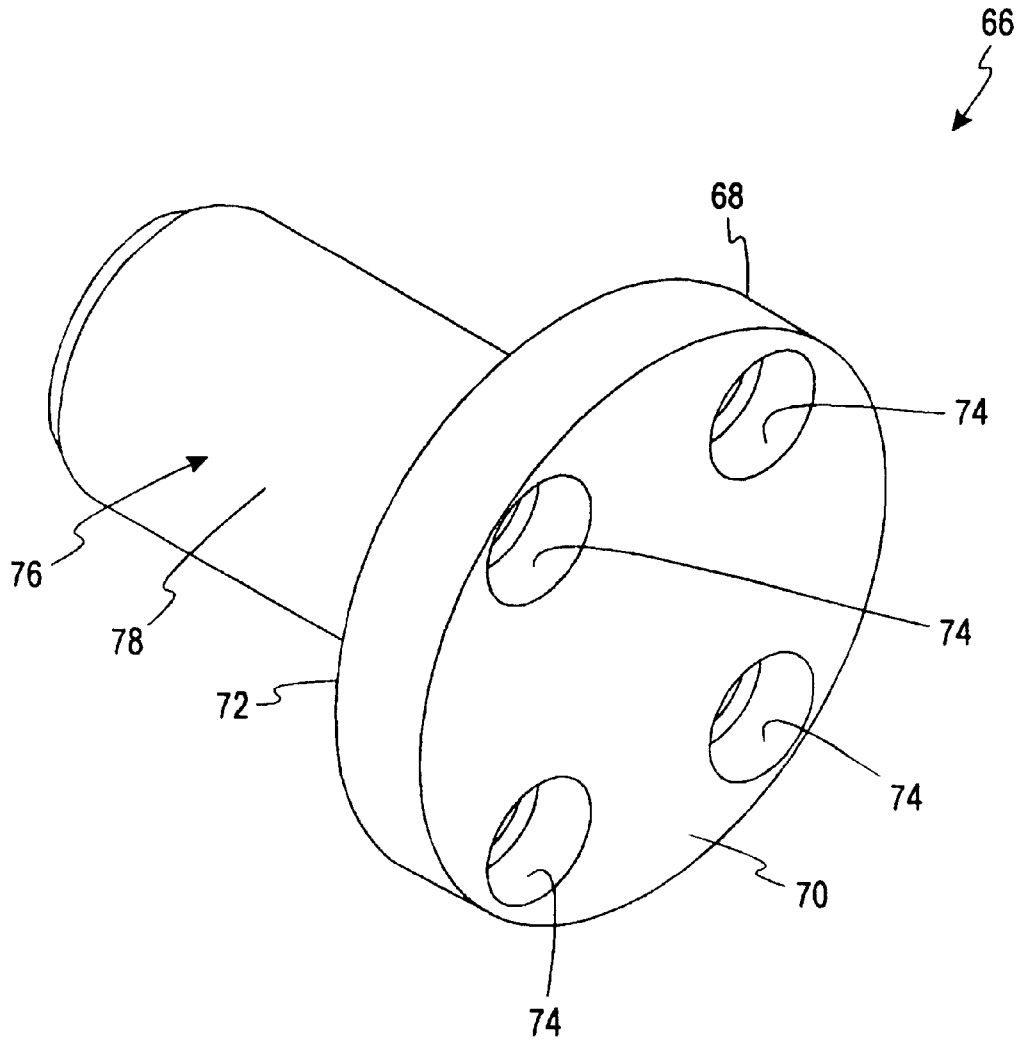
FIG. 6 is a perspective view of a threaded sleeve member that is a part of the alignment mechanism of FIGS. 1–4.

Referring now to FIGS. 4 and 6, in combination, a threaded sleeve member 66 is shown. Threaded sleeve member 66 has a disk portion 68 having an external side 70 and an internal side 72. Four holes 74 are formed in disk portion 68. A sleeve 76 extends from the internal side 72 of the disk portion 68. The sleeve 76 has a smooth exterior surface 78 and internal threads 80 (FIG. 4). The sleeve 76 is slidably received in the smooth internal surface 36 (FIG. 4) of the first attachment element 30. The disk portion 68 is located within the recessed area 38 (FIG. 5B) of the first attachment element 30.

Figure 7:
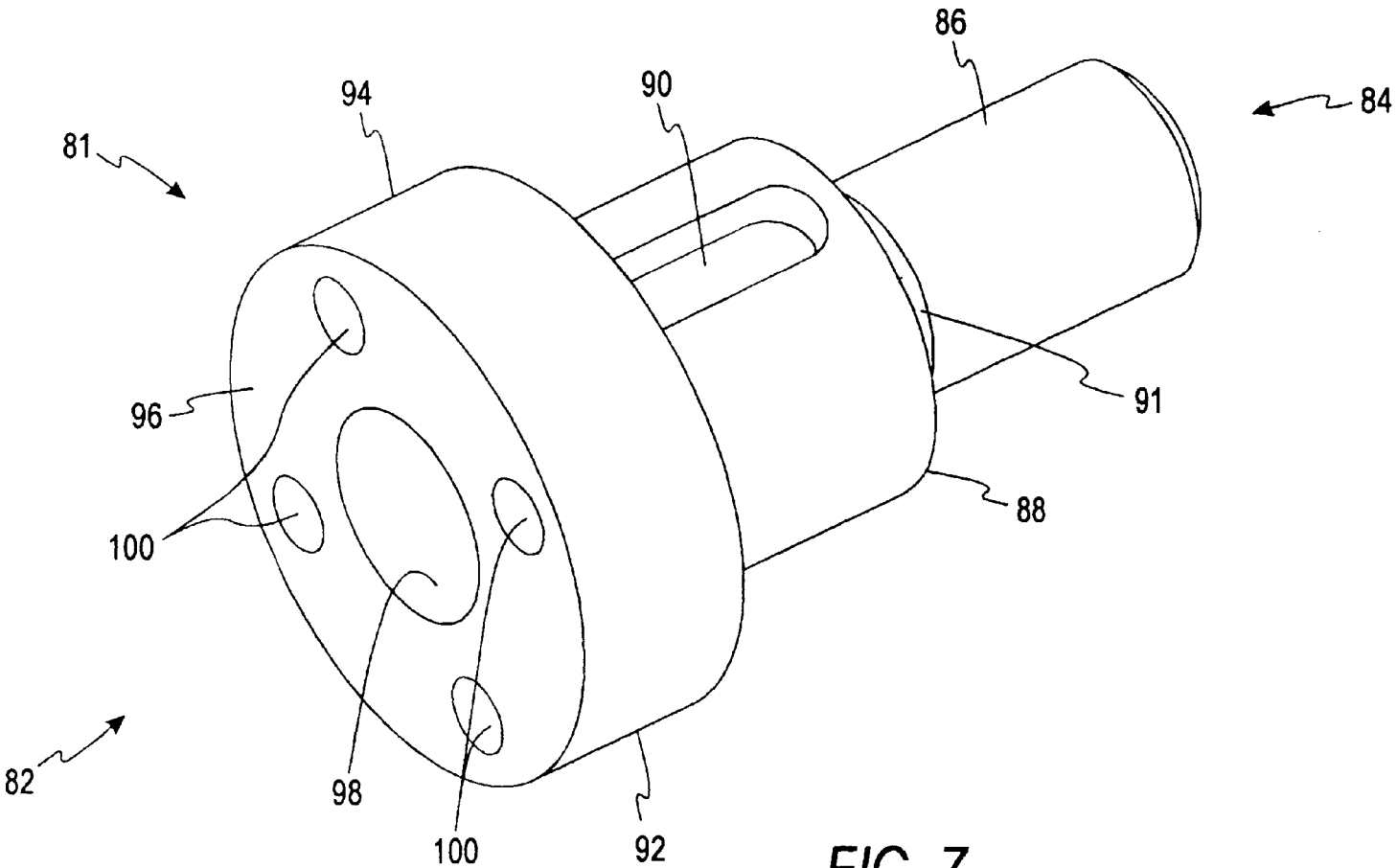
FIG. 7 is a perspective view of a threaded ball joint bushing that is a part of the alignment mechanism of FIGS. 1–4.

Referring now to FIGS. 4 and 7, in combination, a threaded ball joint bushing 81 is shown. Threaded ball joint bushing 81 has a ball joint receiving end 82 and a threaded end 84 (FIG. 7). Externally threaded cylinder 86 is located on threaded end 84. Externally threaded cylinder 86 threadably engages the internal threads 80 of the threaded sleeve member 66 (FIG. 4). The externally threaded cylinder 86 is affixed to a central cylindrical portion 88. Central cylindrical portion 88 has a key slot 90 (FIG. 7) on an external surface thereof The central cylindrical portion 88 defines a mating face 91 that faces towards threaded end 84. The central cylindrical portion 88 is also affixed to a flange member 92, which is located on the ball joint receiving end 82 of the threaded ball joint bushing 81. Flange member 92 has a smooth outer wall 94 and a ball joint mating face 96. Ball joint mating face 96 defines a semi-spherical cavity 98. The flange member 92 additionally has four bolt holes 100 formed therein.

Figure 8:
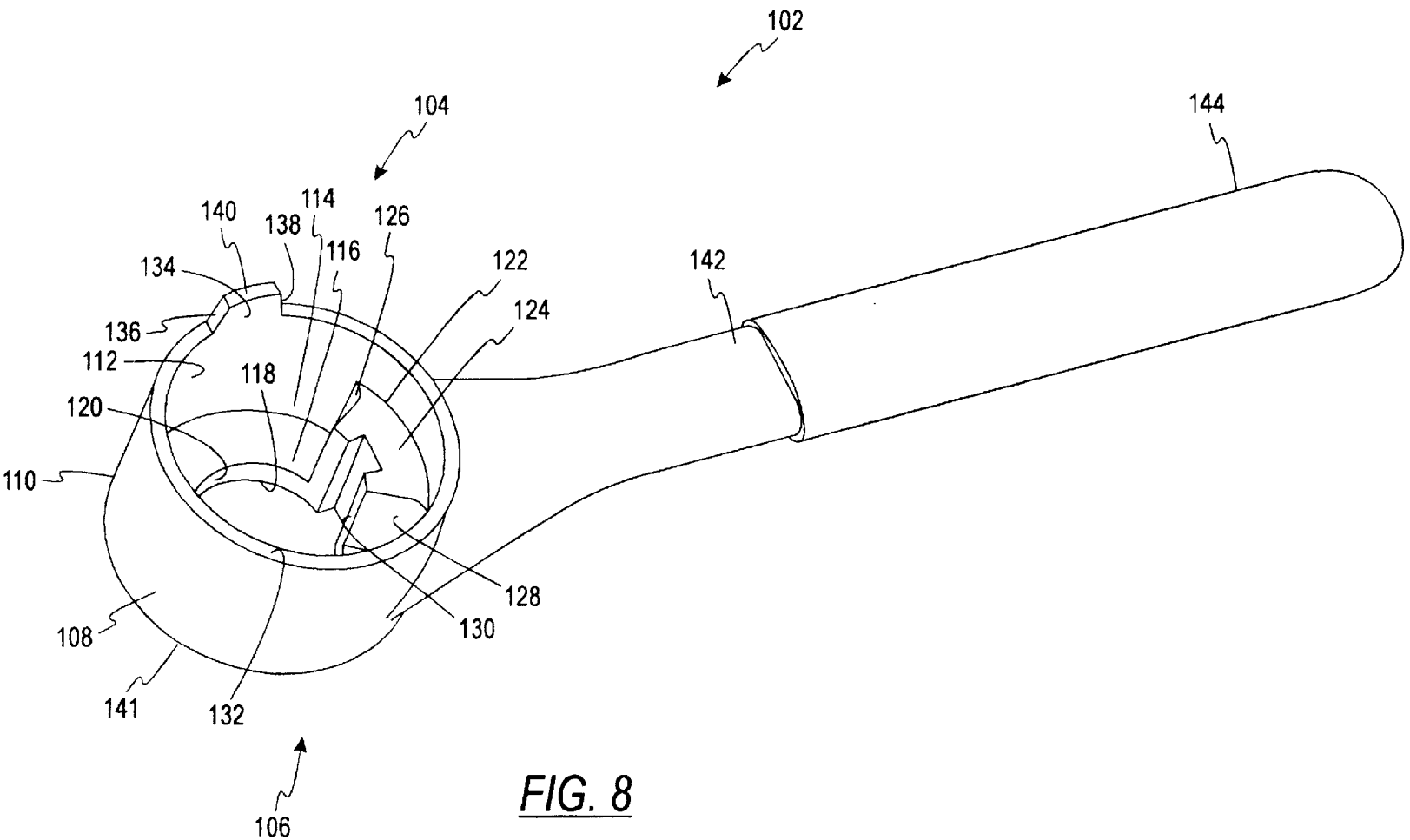
FIG. 8 is a perspective view of a handle member that is a part of the alignment mechanism of FIGS. 1–4.

Referring now to FIGS. 3, 4 and 8, in combination, a handle member 102 is shown. A waggle member or handle member 102 has a centering side 104 and key-way side 106 (FIG. 8). A waggle sleeve or handle sleeve 108 has an external wall 110 and an internal wall 112. Internal wall 112 is in sliding engagement with the smooth exterior wall of tubular extension 48 of first attachment element 30 (FIG. 4). An annular member 114 (FIGS. 4 and 8) is provided on the key-way side 106 of handle member 102. The annular member 114 has an internal face 116 and an external face 118 (FIGS. 4 and 8). The annular member 114 defines an inward facing rim 120 (FIGS. 4 and 8). A stop block 122 (FIGS. 4 and 8) is located on internal wall 112 of the handle sleeve 108. Stop block 122 engages the annular member 114 on one end and has an exposed face 124 on the other end (FIGS. 4 and 8). The exposed face 124 slidably abuts the stop mating face 50 on the first attachment element 30 (FIGS. 4 and 8). The stop block 122 has a first stop surface 126 (FIG. 8) for selective abutment with the first stop 52 (FIG. 5A) on the first attachment element 30. A second stop surface 128 (FIG. 8) is for selective abutment with the second stop 54 (FIG. 5A) of the first attachment element 30. The stop block 122 further defines an inwardly facing keyway 130 (FIG. 8). The external wall 110 has a centering edge 132 (FIGS. 4 and 8) for slidably contacting the handle-mating face 44 on the first attachment element 30 (FIG. 4). The centering edge 132 has a V-shaped protrusion 134 formed thereon. The V-shaped protrusion 134 has a first tapered surface 136, a second tapered surface 138 and a flat bottom surface 140 (FIG. 8). The V-shaped protrusion 134 is provided for complimentary engagement with the V-type recess 46 in the first attachment element 30 (FIGS. 3 and 4). The external wall 110 additionally has a keyway edge 141 on the keyway side 106 (FIGS. 4 and 8). The handle member 102 additionally includes an elongated member 142 that extends radially from handle sleeve 108. The elongated member 142 preferably has a grip 144 provided thereon.

Referring now to FIGS. 4, 7 and 8, in combination, a key 146 (FIG. 4) is located in the inwardly-facing keyway 130 (FIG. 8)of handle member 102. Key 146 engages the key slot 90 (FIG. 7) of the threaded ball joint bushing 81. The key 146 causes the handle member 102 and the threaded ball joint bushing 81 to rotate together when handle member 102 is moved by a user.

Figure 9:
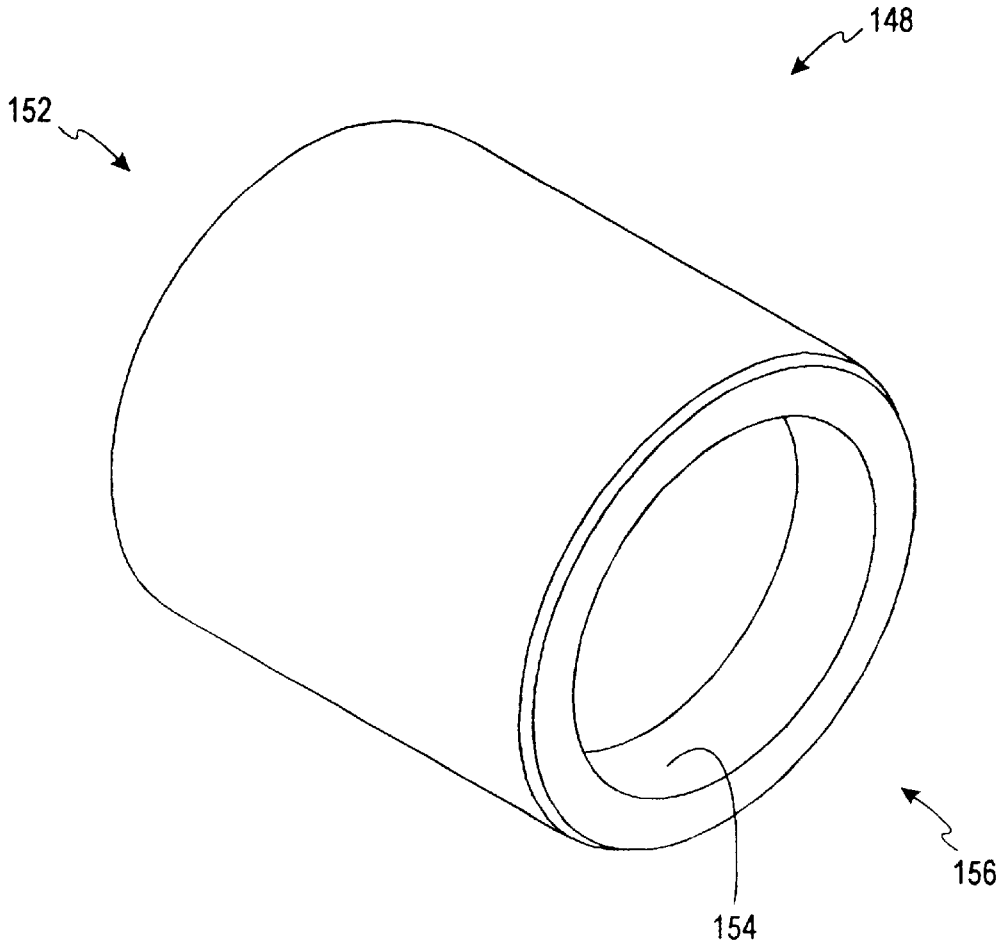
FIG. 9 is a perspective view of an external sleeve that is a part of the alignment mechanism of FIGS. 1–4.

Referring now to FIGS. 3, 4 and 9, in combination, an external sleeve 148 has a spring-engaging rim 150 (FIG. 4) on a first end 152 and an inwardly facing rim 154 (FIGS. 4 and 9) on a second end 156. The spring engaging rim 150 is in slidable engagement with the smooth outer wall 94 of the flange member 92 of the threaded ball joint bushing 81 (FIG. 4).

Figure 10A:
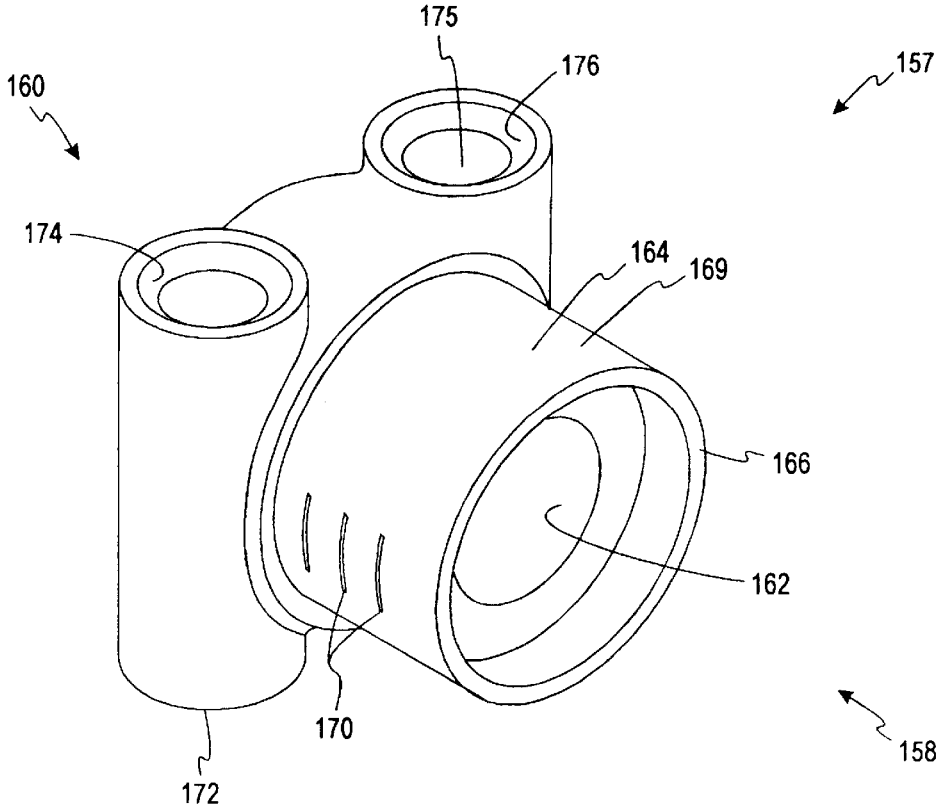
FIG. 10A is a perspective view of a second attachment element that is a part of the alignment mechanism of FIGS. 1–4.

Referring now to FIGS. 3, 4, 10A and 10B, in combination, a second attachment element 157 has a spring engaging end 158 (FIGS. 10A and 10B) and an external end 160. The second attachment element 157 defines an internally threaded passageway 162. Internally threaded passageway 162 is preferably provided with fine threads. A graduated cylinder 164 has a rim 166 (FIGS. 4 and 10A) on the spring engaging end 158. A spring seat 168 (FIGS. 4 and 10A) is provided on spring engaging end 158. The graduated cylinder 164 has a smooth external wall 169 for slidably engaging the inwardly facing rim 154 of the external sleeve 148 (FIG. 4). The smooth external wall 169 preferably has three measuring marks 170 for locating the second end 156 of the external sleeve 148. A third transverse bolt hole 172 is located on the second attachment element 157. Third transverse bolt hole 172 preferably has a chamfered hole 174 (FIGS. 3 and 10A). A fourth transverse bolt hole 175 is also located on the second attachment element 157. The fourth transverse bolt hole 175 preferably also has a chamfered hole 176 (FIG. 10A).

Figure 11:
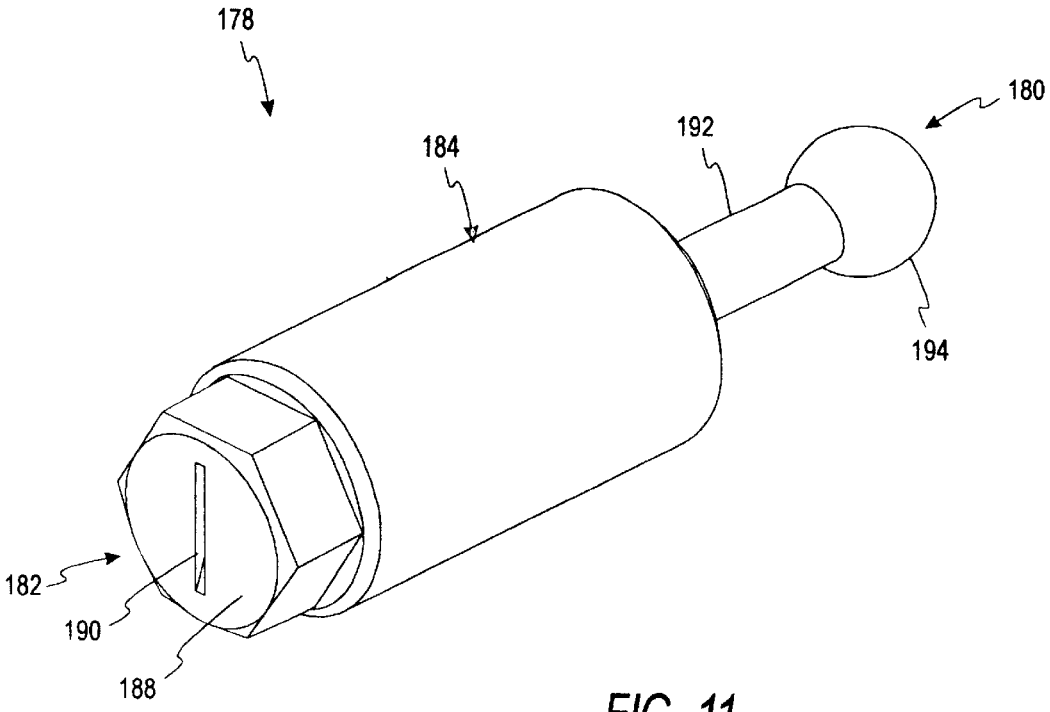
FIG. 11 is a perspective view of an adjustment member that is a part of the alignment mechanism of FIGS. 1–4.

Referring now to FIGS. 3, 4 and 11, in combination, an adjustment member 178 has a ball end 180 (FIG. 11) and an external end 182. The adjustment member 178 has an externally threaded cylindrical body 184 (FIGS. 4 and 11). The threads on externally threaded cylindrical body 184 are preferably fine threads and are sized to mate with the threads in internally threaded passageway 162 of the second attachment element 157 (FIG. 4). Adjustment member 178 has a hex-shaped protrusion on 188 on the external end 182. However, other shapes may be used on adjustment member 178. Preferably, a slot 190 (FIGS. 3 and 11) is formed on hex-shaped protrusion 188. An extension 192 protrudes from the externally threaded cylindrical body 184 and has a ball 194 mounted on a distal end thereof (FIGS. 4 and 11). The ball 194 seats within the semi-spherical cavity 98 of the threaded ball joint bushing 81 (FIG. 4).

Figure 12:
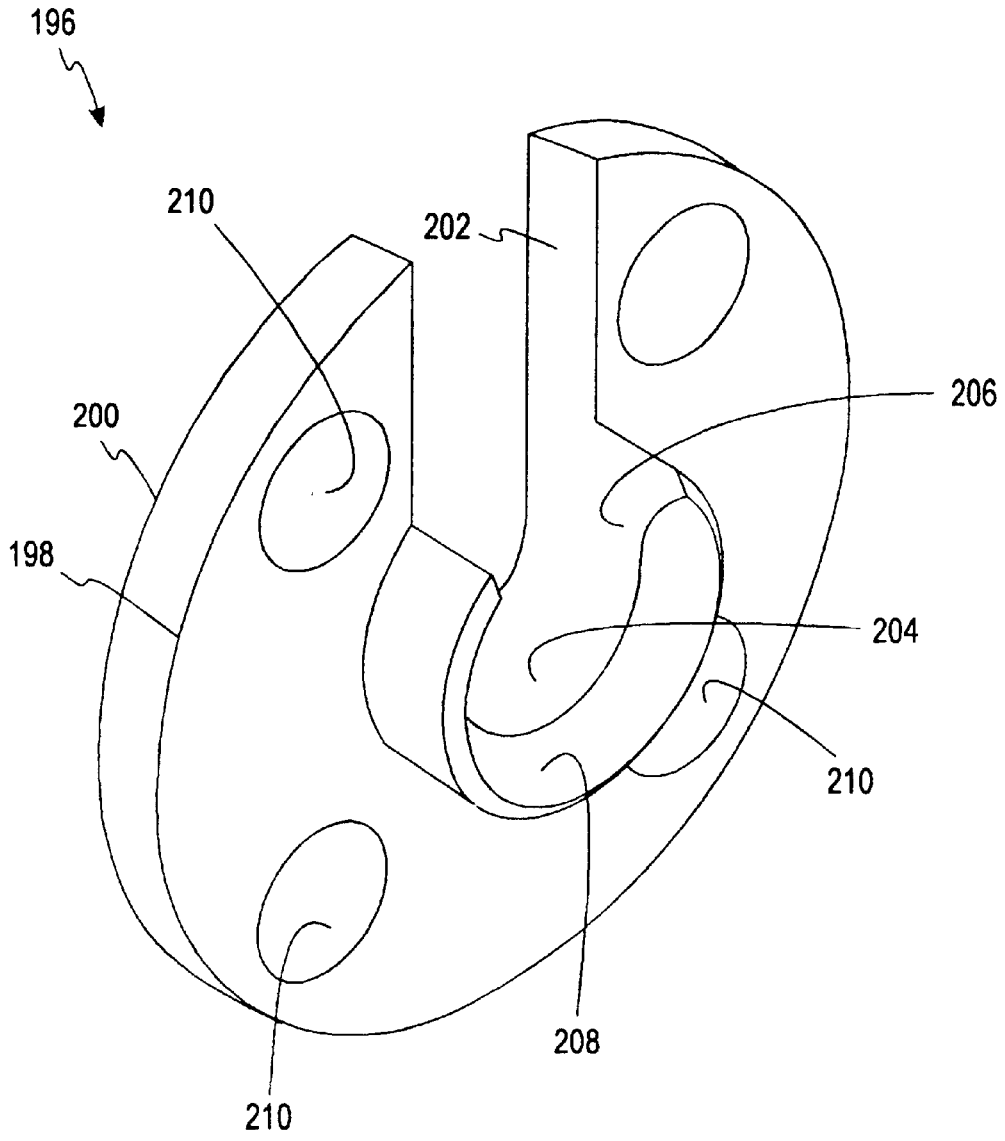
FIG. 12 is a perspective view of a ball joint closure member that is a part of the alignment mechanism of FIGS. 1–4.

Referring now to FIGS. 4 and 12, in combination, a ball joint closure member 196 has a first face 198 and a second face 200 (FIG. 12). A radial slot 202 (FIG. 12) communicates with a central orifice 204. A central tubular protrusion 206 has a semi-spherical seat 208. The central tubular protrusion 206 extends from the first face 198. The first face 198 abuts against the ball joint mating face 96 of the threaded ball joint bushing 81 (FIG. 4). The semi-spherical seat 208 contacts the ball 194 to hold ball 194 within the semi-spherical cavity 98 of the threaded ball joint bushing 81 (FIG. 4). The ball joint closure member 196 has four bolt holes 210 formed therein. Bolts 211 (FIG. 4) are provided for passing through bolt holes 210 of the ball joint closure member 196 and into the bolt holes 100 (FIG. 7) of the threaded ball joint bushing 81 for securing the ball joint closure member 196 to the threaded ball joint bushing 81 thereby securing the ball 194 therebetween (FIG. 4).

Figure 13:
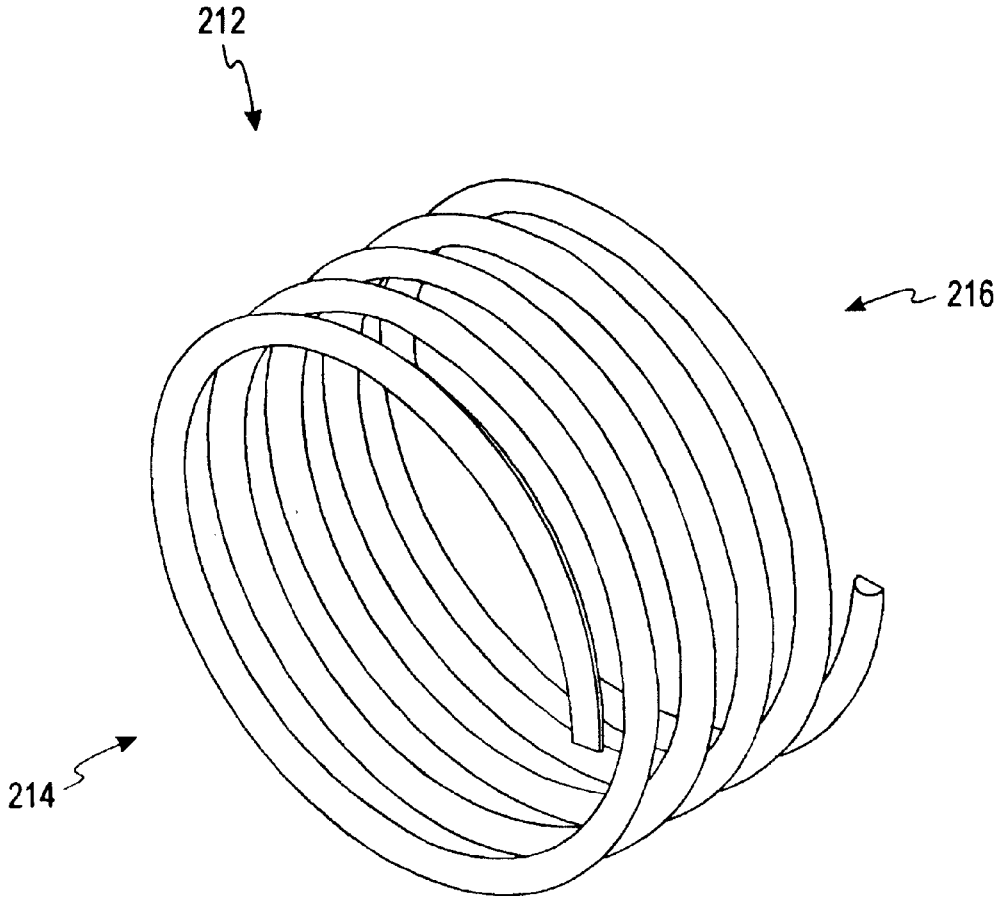
FIG. 13 is a perspective view of a spring that is a part of the alignment mechanism of FIGS. 1–4.

Referring now to FIGS. 4 and 13, in combination, a biasing member, such as spring 212, has a first end 214 that biases against the spring engaging rim 150 of external sleeve 148. Spring 212 additionally has a second end 216 that biases against the spring seat 168 of a second attachment element 157.

Figure 14:
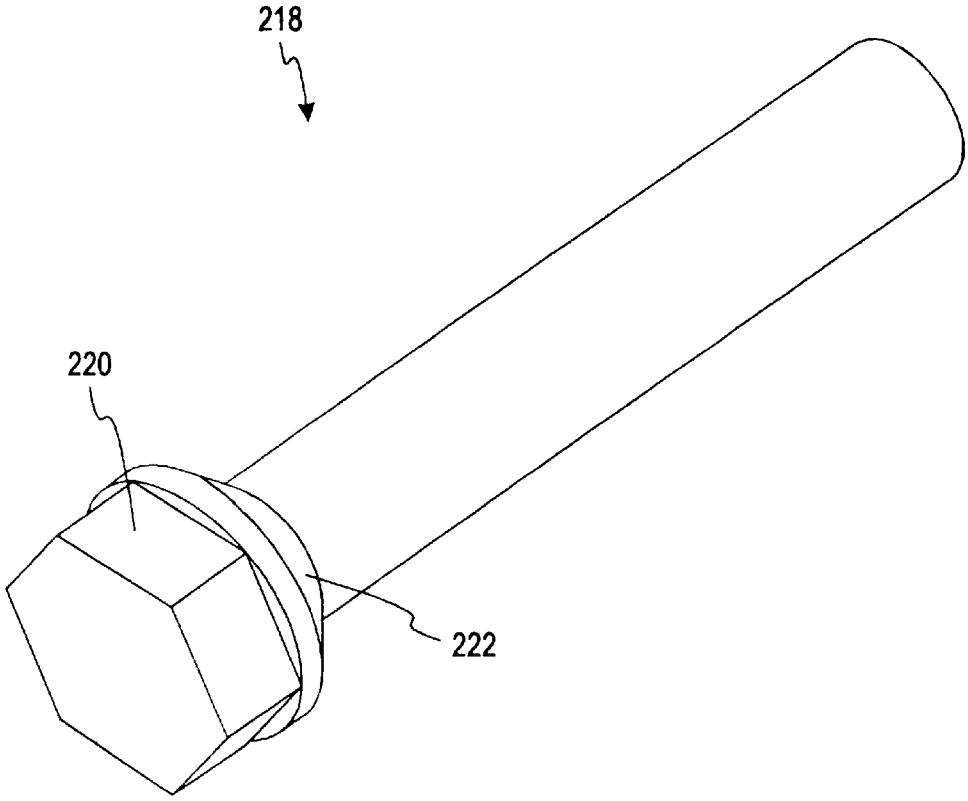
FIG. 14 is a perspective view of an attachment bolt that is a part of the alignment mechanism of FIGS. 1–4.

Referring now to FIGS. 3, 4 and 14, in combination, attachment bolts 218 have a head 220 having a chamfered underside 222 (FIG. 14). Bolts 218 are for insertion within one of the first transverse bolt hole 60, second transverse bolt hole 64, third transverse bolt hole 172 and fourth transverse bolt hole 175 (FIGS. 3 and 4). The chamfered underside 222 is sized for mating engagement with one of chamfered ends 62, 65, 174 and 176 (FIGS. 3 and 4).

Figure 15:
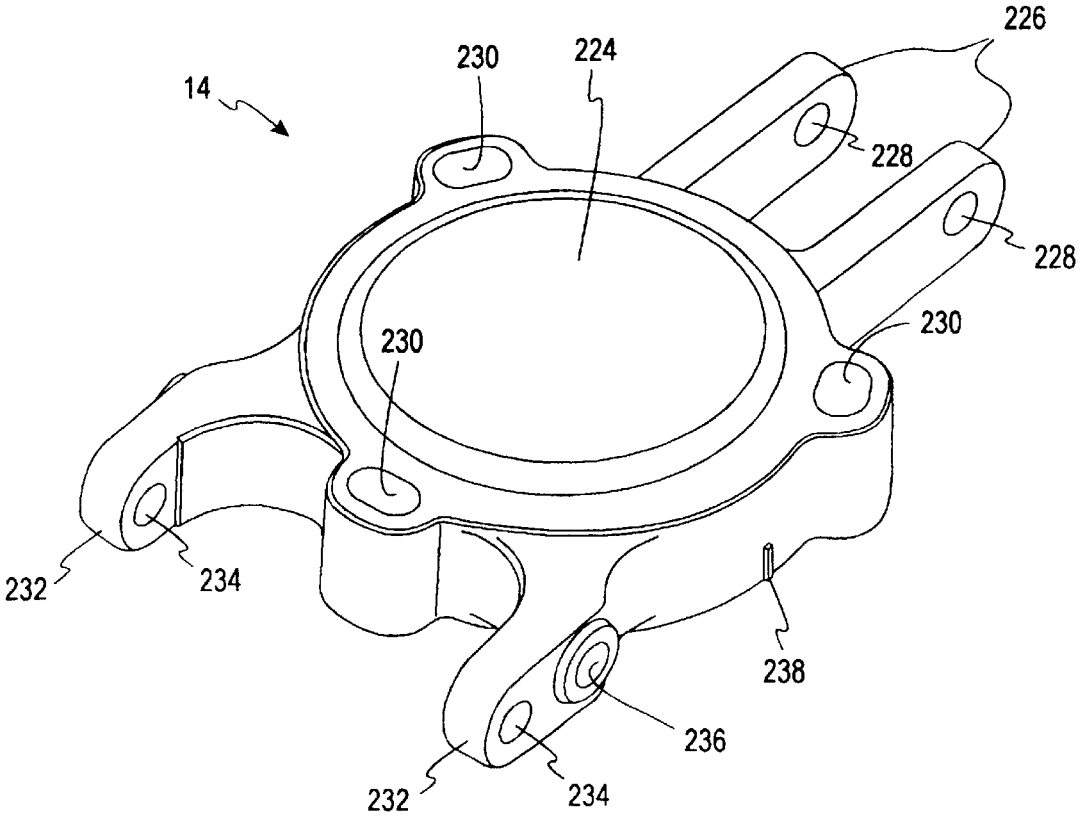
FIG. 15 is a perspective view of an upper casting that is a part of the antenna and its associated mounting structure as shown in FIGS. 1 and 2.

Referring now to FIGS. 1, 2 and 15, in combination, the components necessary for attaching the alignment mechanism 22 to the antenna assembly 10 will be discussed. Upper casting 14 has a body 224 (FIG. 15). A pair of adjustment strut receiving arms 226 extend from body 224 (FIGS. 2 ad 15). Holes 228 are provided in adjustment strut receiving arms 226 to allow for attachment of the adjustment strut 20 to the upper casting 14. Three vertical slotted passageways 230 (FIG. 15) are formed around a perimeter of the body 224, which receive vertical bolts 231 (FIGS. 1 and 2). Also extending from body 224 is a pair of dish-mounting arms 232. Dish mounting arm holes 234 are provided in an end of the dish-mounting arms 232 to allow antenna dish 12 to be mounted to the upper casting 14. Additionally, an alignment mechanism mounting hole 236 is provided on the dish-mounting arms 232. Preferably, an alignment mark 238 (FIG. 15) is provided on an exterior of the body 224.

Figure 16:
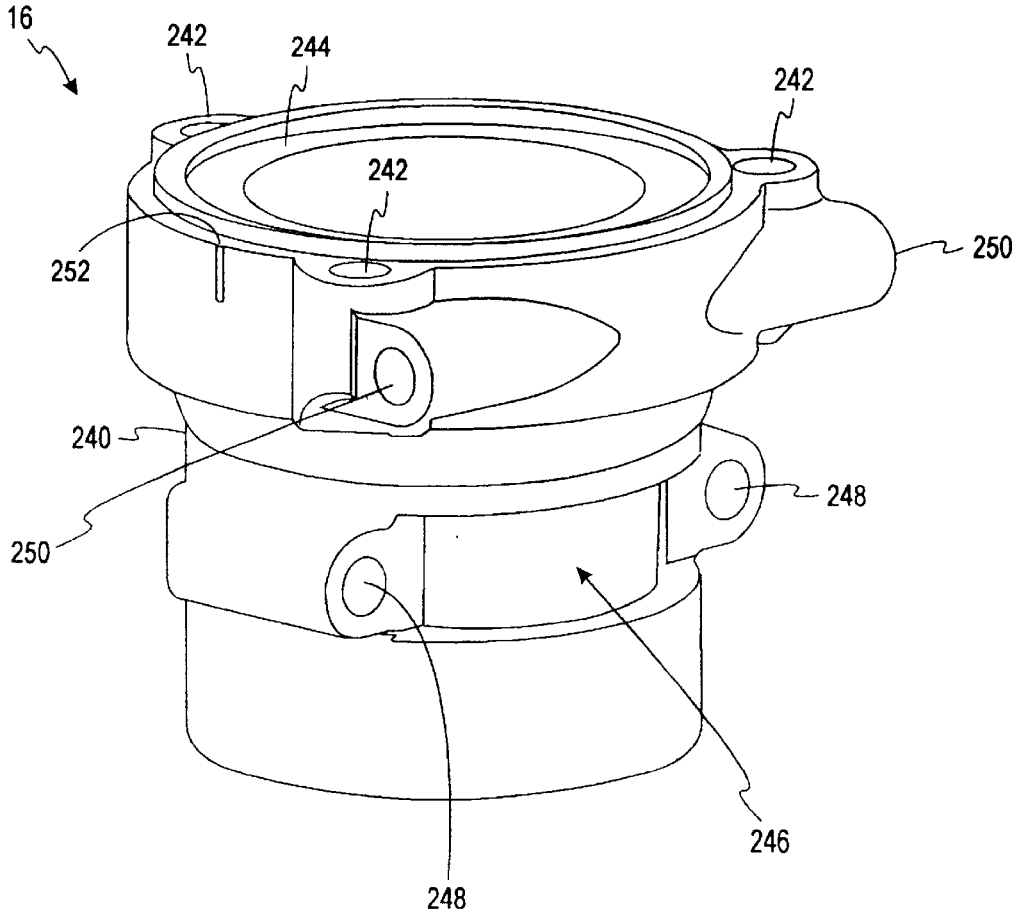
FIG. 16 is a perspective view of a lower casting that is a part of the antenna and its associated mounting structure as shown in FIGS. 1 and 2.

Referring to FIGS. 1, 2 and 16, in combination, lower casting 16 has a tubular body 240. Three vertical holes 242 (FIG. 16) are provided around a perimeter of the tubular body 240. A seat 244 (FIG. 16) is provided on an upper surface of the tubular body 240 for supporting upper casting 14 and for allowing relative rotation between upper casting 14 and lower casting 16. A clamping member slot 246 (FIG. 16) is provided on a lower end of lower casting 16. Additionally, clamping member holes 248 (FIG. 16) are provided. A clamping member 249 (FIGS. 1 and 2) is installed within clamping member slot 246 and secured to clamping member holes 248 with bolts to secure lower casting 16 to support post 18, as shown in FIGS. 1 and 2. Alignment mechanism mounting holes 250 (FIGS. 2 and 16) are provided on a perimeter of the tubular body 240 of lower casting 16. An alignment mark 252 (FIGS. 2 and 16) is provided near an upper surface of the lower casting 16.

Figure 17:
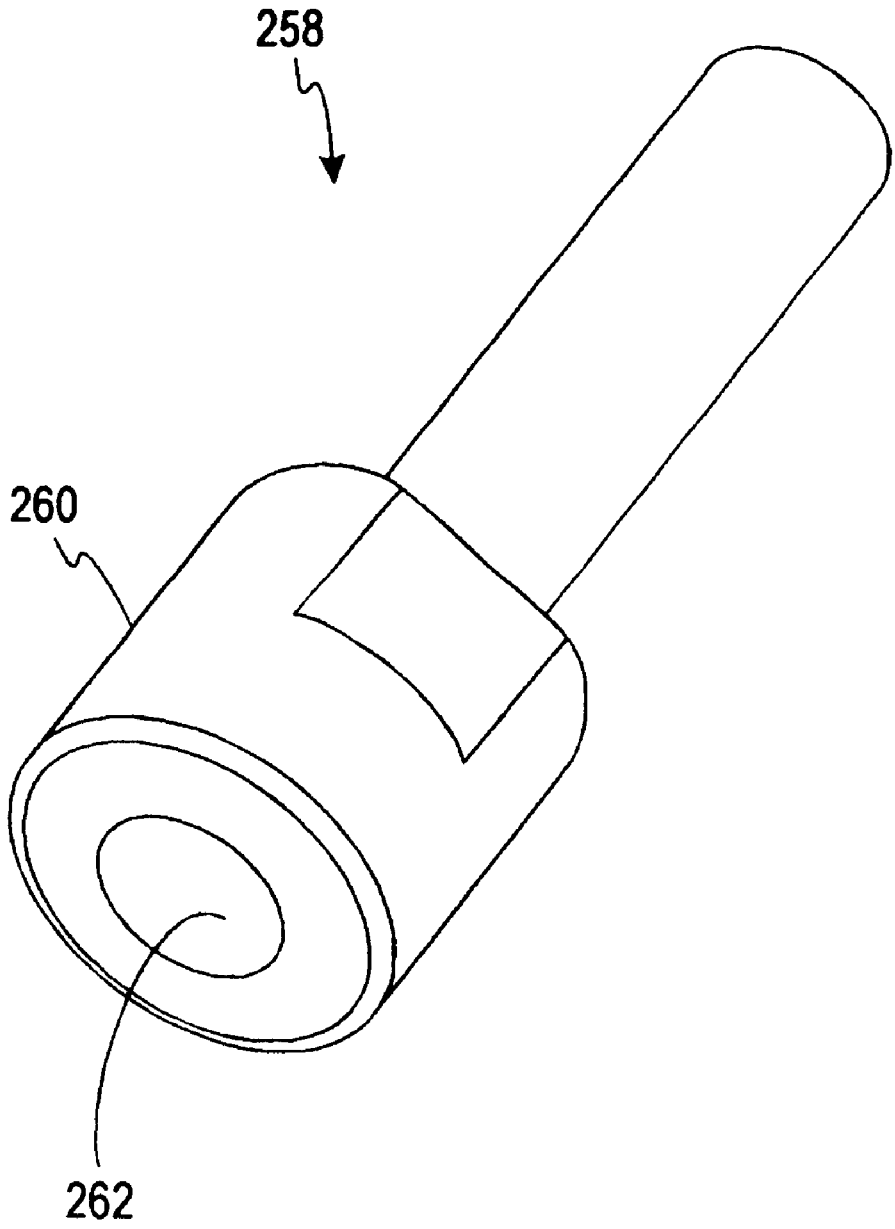
FIG. 17 is a perspective view of a receptacle head bolt that is a part of the antenna and its associated mounting structure as shown in FIGS. 1 and 2.

Referring now to FIGS. 2 and 17, in combination, to install the alignment mechanism 22 to adjust the elevation of the antenna dish 12, the alignment mechanism 22 must be installed on the elevation adjustment strut 20, as shown in FIG. 2. A pair of upper clamping members 254 are located on either side of elevation adjustment strut 20. A bolt 257 clamps a lower half of upper clamping member 254. A receptacle head bolt 258 clamps a lower half of upper clamping member 254. Receptacle head bolt 258 has a head 260 with a receptacle 262 (FIG. 1) formed therein. Receptacle 262 receives attachment bolts 218 (FIGS. 2 and 14) to secure the alignment mechanism 22 to the upper clamping member 254. A lower clamping member 264 is affixed with a bolt 266 through holes 228 in adjustment strut receiving arms 226 (FIG. 2). A receptacle head bolt 258 clamps an upper portion of lower clamping member 262 (FIG. 2). Receptacle 260 receives an attachment bolt 218 for securing adjustment tool 22 to the adjustment strut 20.

Figure 18:
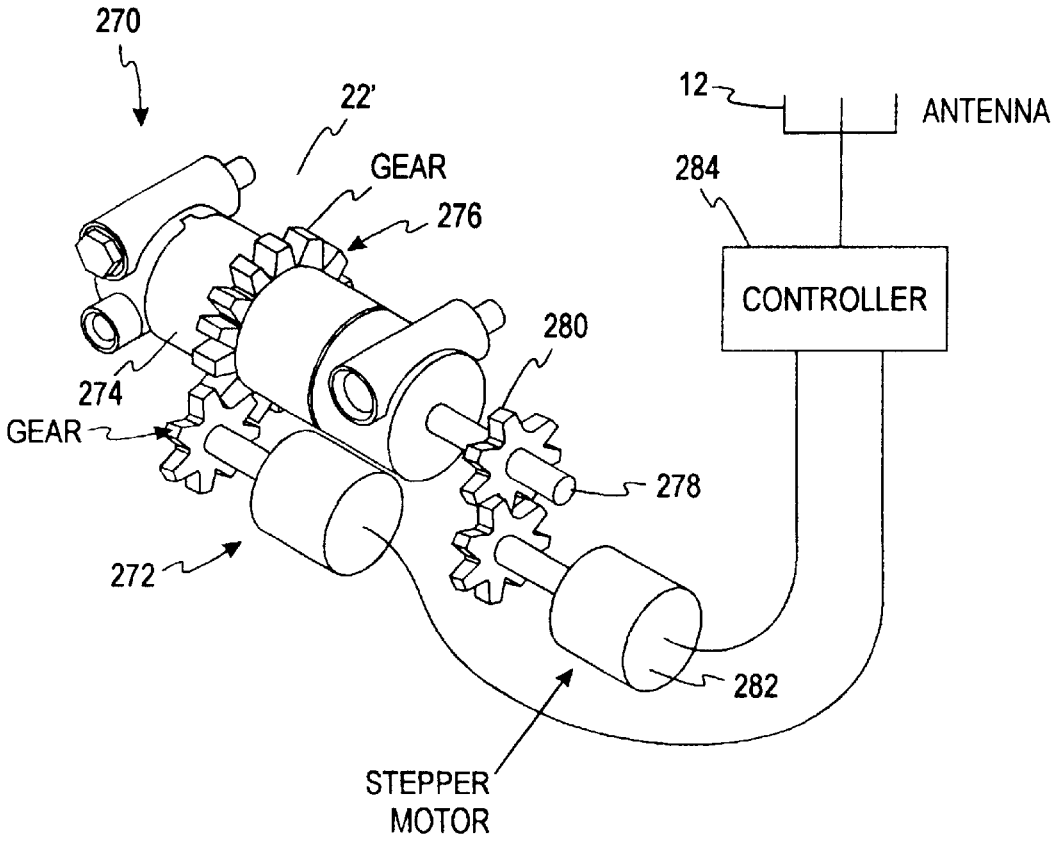
FIG. 18 is a schematic view of an automated alignment mechanism 270.

Referring now to FIG. 18, a schematic view of an automated alignment mechanism 270 is shown. Automated alignment mechanism 270 has the same components as alignment mechanism 22 and operates in the same manner as alignment mechanism 22, with the exception that handle member 102 is replaced with waggle motor 272. Additionally, handle sleeve 108 is replaced with a waggle member or motor engaging sleeve 274. Motor engaging sleeve 274 preferably possesses all of the features described in reference to handle sleeve 108 above, but has an interface 276, such as gear teeth for engaging waggle motor 272. A further modification to alignment mechanism 22 is that adjustment member 178 is replaced with motor engaging adjustment member 278. Motor engaging adjustment member 278 preferably has the same features as adjustment member 178, with the exception that motor engaging adjustment member 278 has an interface 280, such as gear teeth for engaging adjustment motor 282. A controller 284 may be provided to operate waggle motor 272 and adjustment motor 282 for selectively manipulating the automated alignment mechanism 270 in a manner described below.

Figure 10B:
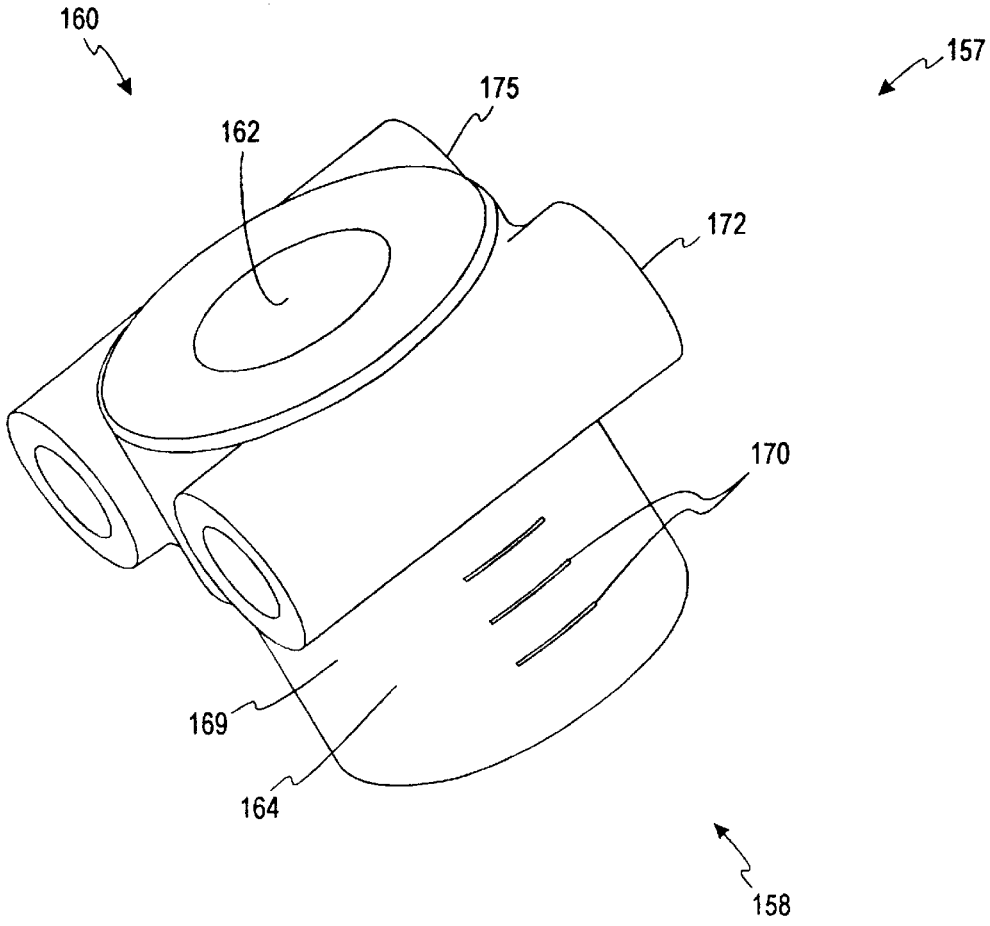
FIG. 10B is a second perspective view of a second attachment element that is a part of the alignment mechanism of FIGS. 1–4.

In use, the azimuth or rotational orientation of antenna dish 12 may be finely adjusted with the alignment mechanism 22 as follows. The antenna dish 12 is aligned to receive a signal, i.e., a "coarse" adjustment is made, before attempting to fine tune with the alignment mechanism 22. The alignment mechanism 22 is then adjusted such that the first end 152 of the external sleeve 148 (FIGS. 4 and 9) is generally aligned with the center measuring mark 170 (FIGS. 4, 10A and 10B). For azimuthal or rotational alignment of antenna dish 12, alignment mechanism 22 is connected to the antenna assembly 10 (FIG. 1). An attachment bolt 218 is located in first transverse bolt hole 60 and engages alignment mechanism mounting hole 236 in upper casting 14 (FIG. 15). A second attachment bolt 218 is located in fourth transverse bolt hole 175 and engages alignment mechanism mounting hole 250 in lower casting 16 (FIG. 16). Vertical bolts 231 are loosened, so that upper casting 14 can rotate a small distance with respect to lower casting 16 due to slots 230 (FIG. 15) formed in upper casting 14. Once the alignment mechanism 22 is affixed in this manner, expansion and contraction of the alignment mechanism 22 will result in rotation of the upper casting 14 and the attached antenna dish 12 relative to the lower casting 16, which is stationarily mounted on support post 18. A similar coarse aligning procedure may be conducted with automated alignment mechanism 270.

To perform the fine tuning operation, the signal strength is recorded while the handle member 102 is in a centered position, as shown in FIGS. 3 and 4. An installation technician, or user, then grasps handle member 102 of alignment mechanism 22 and moves the handle in an upward or downward direction. Alternatively, the motor engaging sleeve 274 may be rotated in a first direction and then a second direction by waggle motor 272 (FIG. 18). Motor engaging sleeve 274 operates in a similar manner to that of handle sleeve 108. For example, if handle member 102 is moved in an upward direction, handle sleeve 108 will move toward the second end 26 of the alignment mechanism 22 as the V-shaped protrusion 134 (FIGS. 3, 4 and 8) on handle sleeve 108 "climbs" out of V-shaped recess 46 (FIG. 4) on first attachment element 30. V-shape protrusion 134 and V-shaped recess 46 form a camming surface therebetween. The axial movement of handle sleeve 108 forces external sleeve 148 towards second end 26, which compresses spring 212 (FIG. 4). The upward rotation of handle member 102 additionally causes a corresponding upward rotation of threaded ball joint member bushing 81 (FIGS. 4 and 7), since the handle member 102 and the threaded ball joint member bushing 81 are keyed together with key 146 (FIG. 4). Handle member 102 is preferably rotated until first stop surface 126 (FIG. 8) abuts first stop 52 (FIG. 5A) of first attachment element 30. The upward rotation of threaded ball joint member bushing 81 will cause the threaded sleeve member 66 to move axially relative to the threaded ball joint member bushing 81, e.g. away from the threaded sleeve member 66, which results in the elongation of the alignment mechanism 22 and a slight clockwise rotation of antenna dish 12. Once the handle member 102 has been rotated to its fill upward position, the signal strength is then recorded. All of the above described manipulations of alignment mechanism 22 may be accomplished with automated alignment mechanism 270.

Alignment mechanism 22 and automated alignment mechanism 270 can accommodate the bending forces imparted upon it by the relative rotation of upper casting 14 and lower casting 16 by flexing across the ball joint formed by ball 194, threaded ball joint bushing 81, and ball joint closure member 196. A seam between key-way side 106 (FIGS. 4 and 8) of handle member 102 and first end 152 of external sleeve 148 (FIGS. 4 and 9) will be aligned with the ball joint once the rotation of handle member 102 has forced the V-shaped protrusion 134 out of V-type recess 46, as explained above. Preferably, alignment mechanism 22 should allow for about 3° of flex.

The user then moves handle member 102 in a downward direction. In an automated embodiment, motor engaging sleeve 274 (FIG. 18) is moved in a downward direction by waggle motor 272. When handle member 102 is moved in an downward direction, handle member 102 will move toward the second end 26 of the alignment mechanism 22 as the V-shaped protrusion 134 (FIGS. 4 and 8) on handle sleeve 108 "climbs" out of V-shaped recess 46 (FIG. 4) on first attachment element 30. The axial movement of handle sleeve 108 forces external sleeve 148 towards second end 26, which compresses spring 212. The downward rotation of handle member 102 additionally causes a corresponding downward rotation of threaded ball joint member bushing 81, since the handle member 102 and the threaded ball joint member bushing 81 are keyed together with key 146 (FIG. 4). Handle member 102 is rotated until second stop surface 128 (FIG. 8) abuts second stop 54 (FIG. 5A) of first attachment element 30. The downward rotation of threaded ball joint member bushing 81 will cause the threaded sleeve member 66 to move axially relative to the threaded ball joint member bushing 81, e.g. towards the threaded sleeve member 66, which results in the contraction of the alignment mechanism 22 and a slight counter-clockwise rotation of antenna dish 12. Once the handle member 102 has been rotated to its full downward position, the signal strength should again be recorded. The handle member 102 is then returned to its centered position, wherein the V-shaped protrusion 134 is seated in the V-shaped recess 46. A secure seating of the V-shaped protrusion 134 in the V-shaped recess 46 is assured by the biasing action of spring 212. The secure seating of the V-shaped protrusion 134, i.e. centering of the handle member 102, assures that the antenna dish 12 is returned to its original position. Again, the above-described manipulation of alignment mechanism 22 will be the same if automated alignment mechanism 270 is used, wherein handle member 102 and handle sleeve 108 are replaced with motor engaging sleeve 274, which is moved from position to position by waggle motor 272 (FIG. 18).

A comparison is then made between the signal strength at the full upward position of the handle member 102 or motor engaging sleeve 274 (FIG. 18), i.e., the upward limit signal, the centered position of the handle member 102 or motor engaging sleeve 274, and the full downward position of the handle member 102 or motor engaging sleeve 274, i.e. the lower limit signal. If the signal at the centered position of handle member 102 or motor engaging sleeve 274 is weaker than, e.g. the signal at the full upward position of handle member 102, then adjustment member 178 (FIGS. 4 and 11) is rotated by manipulating the hex-shaped protrusion 188 or slot 190 to expand or contract the alignment mechanism 22. Alternatively, motor engaging adjustment member 278 is rotated by adjustment motor 282. Once the adjustment member 178 or motor engaging adjustment member 278 has been adjusted, the process of recording signals at the above described positions of handle member 102 or motor engaging sleeve 274 is repeated until the signal is strongest at the centered position of the handle member 102 or motor engaging sleeve 274. The upward and downward movements of the handle member 102 or motor engaging sleeve 274 shall be referred to herein as "waggling" the handle member 102 or motor engaging sleeve 274 to determine optimal orientation of antenna dish 12.

Once the position of the antenna dish 12 has been optimized, vertical bolts 231 (FIGS. 1 and 2) are tightly secured to prevent rotation of upper casting 14 relative to lower casting 16, i.e., prevent further rotation of antenna dish 12. The alignment mechanism 22 may then be removed by removing attachment bolts 218.

Referring back to FIG. 2, it may be seen that adjustments to the elevation of antenna dish 12 are made with the alignment mechanism 22 secured to the adjustment strut 20. An upper clamping member 254 is tightly secured to adjustment strut 20 with a receptacle head bolt 258. This aspect is best seen in FIGS. 2 and 17, in combination. An attachment bolt 218 is located in second transverse bolt hole 60 and engages receptacle 262 of receptacle head bolt 258 on upper clamping member 254. Another attachment bolt 218 is located in fourth transverse bolt hole 175 and engages receptacle 262 (FIG. 17) of receptacle head bolt 258 on lower clamping member 264. Receptacle head bolt 258 on lower clamping member 264 is then loosened to permit movement of adjustment strut 20 within the lower clamping member 264.

Still referring primarily to FIG. 2, the waggling steps, adjustment steps, and signal strength recording steps described above are then performed to repeatedly slightly increase and decrease the elevation of antenna dish 12 to optimize the elevation of the antenna dish 12. Once the optimal elevation has been achieved, the receptacle head bolt 258 on lower clamping member 264 is then tightened to prevent further movement of adjustment strut 20 within the lower clamping member 264. The desired elevation of the antenna dish 12 is then maintained. Attachment bolts 218 are then removed to remove the alignment mechanism 22. Upper clamping members 254 are then removed.

It should be noted that precise adjustments of the alignment mechanism 22 or automated alignment mechanism 270 are possible because of the anti-backlash features present in the alignment mechanism 22 or automated alignment mechanism 270. In particular, when adjustment member 178 or motor engaging adjustment member 278 is rotated, or when threaded sleeve member 66 is rotated via handle member 102 or motor engaging sleeve 274, backlash is minimized due to the biasing action of spring 212, which holds the threaded interfaces in tension. Additionally, the chamfered holes in the first transverse bolt hole 60, second transverse bolt hole 64, third transverse bolt hole 172 an fourth transverse bolt hole 175, when used in conjunction with the chamfered underside 222 of attachment bolts 218, minimize movement of the alignment mechanism 22 when it is secured to the antenna assembly 21. Therefore, more accurate readings can be achieved.

Although preferred embodiment(s) of the present invention have been illustrated in the accompanying Drawings and described in the foregoing Description, it will be understood that the present invention is not limited to the embodiment(s) disclosed, but is capable of numerous rearrangements, modifications, and substitutions without departing from the spirit and scope of the present invention as set fourth and defined by the following claims. For example, other possible configurations include, but are not limited to, a rotary configuration of the apparatus, a permanently installed apparatus, or other embodiments of the invention.

What is claimed is:

1. A waggle tool comprising:

a first attachment element for removably attaching to an antenna mounting member;

a threaded sleeve member affixed to said first attachment element;

a threaded bushing for threadably engaging said threaded sleeve member;

a waggle member for rotating said threaded bushing;

a second attachment element for removably attaching to an antenna mounting base member, said second attachment element operatively connected to said threaded bushing; and a biasing member adapted for biasing said first attachment element apart from said second attachment element.

2. The waggle tool according to claim 1 wherein:

said waggle member is a handle member.

3. The waggle tool according to claim 1 wherein:

said waggle member is a motor engaging sleeve.

4. The waggle tool according to claim 1 further comprising:

an adjustment member threadably connected to said second attachment element and operatively connected to said threaded bushing, said adjustment member for selectively adjusting an axial distance between said first attachment element and said second attachment element.

5. The waggle tool according to claim 4 wherein:

said adjustment member is connected to said threaded bushing at a ball joint, which permits relative rotation between said adjustment member and said threaded bushing.

6. The waggle tool according to claim 4 wherein:

said adjustment member is connected to said threaded bushing at a ball joint, which permits relative axial deflection of said adjustment member with respect to said threaded bushing.

7. The waggle tool according to claim 6 wherein:

said axial deflection is at least 3°.

8. The waggle tool according to claim 2 further comprising:

a centering device at an interface between said first attachment element and said handle member for locating said first attachment element and said handle member in a desired rotational orientation.

9. The waggle tool according to claim 8 wherein said centering device comprises:

a recess on said first attachment element;

a protrusion on said waggle member for complementary engagement with said recess on said first attachment element; and wherein said biasing member forces said protrusion into said recess for indicating a desired rotational orientation between said first attachment element and said waggle member.

10. The waggle tool according to claim 1 wherein:

said first attachment element has a receptacle having a chamfered hole;

an attachment bolt located in said receptacle for securing the waggle tool to a device, said attachment bolt having a head with a chamfered underside, said chamfered underside for engagement with said chamfered hole for minimizing backlash.

11. The waggle tool according to claim 1 further comprising:

a key slot on said threaded bushing;

a keyway on said waggle member; and a key located in said key slot and said keyway, said key for operatively locking said threaded bushing and said handle member together so that said threaded bushing and said handle member.

12. The waggle tool according to claim 1 further comprising:

a first stop on said first attachment element;

a second stop on said first attachment element;

a stop block on said waggle member having a first stop surface for selective abutment with said first stop on said first attachment element and a second stop surface for selective abutment with said second stop on said first attachment element, said abutment for defining a discrete amount of rotation capable by said waggle member.

13. The waggle tool according to claim 1 further comprising:

an external sleeve slidably mounted on said second attachment element, said external sleeve having a first end that abuts said waggle member and a rim for engaging a first end of said biasing member; and a seat on said second attachment element for receiving a second end said biasing member;

wherein said biasing member biases said handle member away from said second attachment element.

14. The waggle tool according to claim 1 further comprising:

an external sleeve slidably mounted on said second attachment element, said external sleeve having a second end;

markings on an outer surface of said second attachment element; and wherein said markings are used to determine an extent of linear expansion/contraction of the waggle tool.

15. The waggle tool according to claim 1 wherein:

said second attachment element has a receptacle having a chamfered hole; and an attachment bolt located in said receptacle for securing the waggle tool to an antenna mounting member, said attachment bolt having a head with a chamfered underside, said chamfered underside for engagement with said chamfered hole for minimizing backlash.

16. An antenna alignment system comprising:

an antenna mounting assembly adapted for select positioning and securing of an antenna; and a waggle tool adapted for coupling to said antenna mounting assembly for select adjustment of the antenna into a first set position and a subsequent, staged waggle movement thereabout.

17. The antenna alignment system according to claim 16 wherein said antenna mounting assembly is adapted for select positioning and securing of azimuthal and elevational orientations of the antenna; and said waggle tool is adapted for coupling to said mounting assembly for select adjustment of said azimuthal and said elevational orientations of said antenna.

18. The antenna alignment system according to claim 17 wherein said antenna mounting assembly for said azimuthal positioning includes a base mounting member from which the azimuthal position of the antenna is secured and an antenna support member, the position thereof relative to said base mounting member defining the azimuthal orientation of the antenna, and wherein said waggle tool is adapted for demountable coupling to said base mounting member and said antenna support member for adjusting antenna azimuthal orientation in a first set position and for adjusting antenna azimuthal orientation with a stepped waggle movement thereabout.

19. The antenna alignment system according to claim 17 wherein said antenna mounting assembly for said elevational positioning includes a mounting member from which the elevational position of the antenna is secured and an antenna support strut, the position of said antenna support strut relative to a mounting collar defining the elevational orientation of the antenna, and wherein said waggle tool is adapted for demountable coupling to said mounting collar and said antenna support strut for the adjustment of said antenna elevational orientation in a first set position and a stepped waggle movement thereabout.

20. The antenna alignment system set forth in claim 16 wherein said antenna mounting assembly includes a base connector from which the position of the antenna is refined and secured and to an antenna support member, a position of said antenna support member relative to said base connector defining a position of the antenna, and wherein said waggle tool includes a first end adapted for coupling to said antenna support member and a second end adapted for coupling to said base connector, and wherein a distance from said first end to said second end of said waggle tool is selectively variable in linear extent for select movement of the antenna.

21. The antenna alignment system according to claim 20 wherein said waggle tool includes first and second threaded portions coupled together, each being adapted to vary said linear extent of said waggle tool by a select rotation of said threaded portions.

22. The antenna alignment system according to claim 21 wherein rotation of said first threaded portion translates into variations of said linear extent of said waggle tool.

23. The antenna alignment system according to claim 21 wherein waggle actuation of said second threaded portion translates into variation of said linear extent of said waggle tool by rotating said second threaded portion by generally equal amounts in opposite directions for the determination of antenna alignment.

24. The antenna alignment system according to claim 21 wherein said first and second threaded portions are biased relative to an end of said waggle tool for reducing backlash therein relative to the rotation thereof.

25. The antenna alignment system according to claim 24 and further comprising a spring disposed within said waggle tool to provide said biasing.

26. The antenna alignment system according to claim 21 wherein said second threaded portion is adapted for waggle actuation and includes a manually rotatable handle member extending from said waggle tool and coupled to a threaded member rotatably mounted within said waggle tool, said handle being adapted for selectively rotating said threaded member for varying a linear extent of said waggle tool in each direction of rotation.

27. The antenna alignment system according to claim 26 wherein:

said handle member and a first attachment member of said waggle tool are disposed adjacent one another and defining a camming surface therebetween, said camming surface adapted for imparting axial movement to said handle member during the rotation thereof, thereby providing a home position for said handle member with respect to rotation of said handle member relative to said adjacent first attachment member, said camming surface facilitating a manual return of said waggle tool to an original length and said antenna to an original orientation.

28. The antenna alignment system according to claim 21 wherein said second threaded portion is adapted for waggle actuation and includes a motor driven waggle sleeve extending from said waggle tool and coupled to a threaded member rotatably mounted within said waggle tool, said waggle sleeve being adapted for selectively rotating said threaded member for varying a linear extent of said waggle tool in each direction of rotation.

29. The antenna alignment system according to claim 28 wherein:

said motor driven waggle sleeve and a first attachment member of said waggle tool are disposed adjacent one another and defining a camming surface therebetween, said camming surface adapted for imparting axial movement to said motor driven waggle sleeve during the rotation thereof, thereby providing a home position for said waggle tool with respect to rotation of said motor driven waggle sleeve relative to said adjacent first attachment member, said camming surface facilitating a manual return of said waggle tool to an original length and said antenna to an original orientation.

30. A method of aligning an antenna at peak signal strength using an alignment mechanism, comprising the steps of:

affixing an alignment mechanism to an orienting member and to a stationary member on an antenna mounting assembly;

expanding said alignment mechanism by a select length based on a preliminary length of said alignment mechanism and a signal strength at a first antenna orientation, thereby changing an orientation of said antenna in a first direction;

contracting said alignment mechanism by a select length based on a signal strength at a second antenna orientation, thereby changing said orientation of said antenna in a second direction;

returning said alignment mechanism to said preliminary length;

adjusting a length of said alignment mechanism to obtain a new preliminary length based upon a signal strength at a third antenna orientation;

repeating said steps of expanding and contracting said alignment mechanism until said preliminary length corresponds to a signal strength that is stronger than said signal strength at said second antenna orientation and said third antenna orientation; and securing said antenna in a desired orientation.

31. A method for aligning an antenna, comprising:

setting a coarse position of the antenna; and setting a fine position of the antenna, comprising:

a. waggling the antenna and taking limit signal measurements, b. adjusting the antenna center position in a direction of a desired signal characteristic obtained from said limit signal measurements; and c. repeating steps a and b until limit signal measurements indicate that the antenna is positioned for said desired signal characteristic.

32. The method defined by claim 31, including taking center as well as limit signal strength measurements, and centering the antenna position before adjusting the antenna position.

33. Antenna alignment system, comprising:

first means for setting a coarse position of the antenna; and second means for setting a fine position of the antenna, comprising a) means for waggling the antenna about a center position, and b) means for selectively adjusting the antenna center position.

34. An antenna alignment mechanism for use with an adjustable antenna mount having a moveable member that is coupled to an antenna and so configured that movement of the moveable member causes the antenna to make an alignment adjustment, an antenna alignment mechanism comprising:

a selectively extensible and contractible operator mechanically coupled to said moveable member such that extension and contraction thereof about a center dimension causes said antenna to waggle about a center position; and means for selectively incrementing or decrementing the center dimension of said operator to change the center position of the antenna.

35. The antenna alignment mechanism defined by claim 34, wherein said moveable member is a rotatable antenna mount which, when rotated, causes the azimuthal orientation of the antenna to change, and wherein said operator is coupled tangentially to said mount.

36. The antenna alignment mechanism defined by claim 34, wherein said moveable member is a strut structure which, when moved, causes the elevational orientation of the antenna to change, and wherein said operator is coupled to said strut.

37. An antenna alignment system comprising:

a system of moveable members for effecting a coarse alignment of an antenna;

a fine alignment system, comprising:

a) a selectively extensible and contractible operator mechanically coupled to one or more of said moveable members such that extension and contraction of said operator about a center dimension causes said antenna to waggle about a center position; and b) means for selectively incrementing or decrementing the center dimension of said operator to change the center position of the antenna.

38. The antenna alignment system defined by claim 37, wherein said moveable members include a rotatable antenna mount which, when rotated, causes the azimuthal orientation of the antenna to change, and wherein said operator is coupled tangentially to said mount.

39. The antenna alignment system defined by claim 37, wherein said moveable members includes a strut structure which, when moved, causes the elevational orientation of the antenna to change, and wherein said operator is coupled to said strut.

* * * * *